US010513790B2

(12) United States Patent
Fortin et al.

(10) Patent No.: US 10,513,790 B2
(45) Date of Patent: Dec. 24, 2019

(54) DIELECTRIC BARRIER DISCHARGE PLASMA METHOD AND APPARATUS FOR SYNTHESIZING METAL PARTICLES

(71) Applicant: UNIVERSITÉ LAVAL, Québec, Québec (CA)

(72) Inventors: Marc-André Fortin, Québec (CA); Mathieu Bouchard, Québec (CA); Christian Sarra-Bournet, Sherbrooke (CA); Stéphane Turgeon, Québec (CA)

(73) Assignee: UNIVERSITÉ LAVAL, Québec (CA)

( * ) Notice: Subject to any disclaimer, the term of this patent is extended or adjusted under 35 U.S.C. 154(b) by 0 days.

(21) Appl. No.: 15/537,279

(22) PCT Filed: Dec. 15, 2015

(86) PCT No.: PCT/CA2015/051326
§ 371 (c)(1),
(2) Date: Jun. 16, 2017

(87) PCT Pub. No.: WO2016/095035
PCT Pub. Date: Jun. 23, 2016

(65) Prior Publication Data

US 2018/0051382 A1 Feb. 22, 2018

Related U.S. Application Data

(60) Provisional application No. 62/092,867, filed on Dec. 17, 2014.

(51) Int. Cl.
*C25C 7/06* (2006.01)
*C25C 1/20* (2006.01)
(Continued)

(52) U.S. Cl.
CPC ..... *C25C 7/06* (2013.01); *B22F 1/0018* (2013.01); *B22F 9/12* (2013.01); *B22F 9/16* (2013.01);
(Continued)

(58) Field of Classification Search
CPC .... C25C 1/20; C25C 5/02; C25C 7/00; C25C 7/02; C25C 7/06; B22F 1/0018;
(Continued)

(56) References Cited

U.S. PATENT DOCUMENTS 7,807,112 B2 10/2010 Denes et al.
8,529,749 B2 9/2013 Sankaran
(Continued)

FOREIGN PATENT DOCUMENTS

CA 2693686 A1 1/2009
CA 2859694 A1 6/2012
(Continued)

OTHER PUBLICATIONS

C. Richmonds et al., "Plasma-liquid electrchemistry: Rapid synthesis of colloidal metal nanoparticles by microplasma reduction of aqueous cations," Applied Physics Letters, vol. 93, 2008, 131501.
(Continued)

*Primary Examiner* — Ciel P Thomas
(74) *Attorney, Agent, or Firm* — Baker & Hostetler LLP

(57) ABSTRACT

A dielectric barrier discharge (DBD) plasma apparatus for synthesizing metal particles is provided. The DBD plasma apparatus includes an electrolyte vessel for receiving an electrolyte solution comprising metal ions; an electrode spaced-apart from the electrolyte vessel; a dielectric barrier interposed between the electrolyte vessel and the electrode such that, when the electrolyte solution is present in the electrolyte vessel, the dielectric barrier and an upper surface of the electrolyte solution are spaced-apart from each other
(Continued)

and define a discharge area therebetween; and gas inlet and outlet ports in fluid communication with the discharge area such that supplying gas in the discharge area while applying an electrical potential difference between the electrode and the electrolyte solution cause a plasma to be produced onto the electrolyte solution, the plasma interacting with the metal ions and synthesizing metal particles. A method for synthesizing metal particles using a DBD plasma apparatus is also provided.

23 Claims, 28 Drawing Sheets

(51) Int. Cl.

| | |
|---|---|
| ***C25C 5/02*** | (2006.01) |
| ***C25C 7/00*** | (2006.01) |
| ***C25C 7/02*** | (2006.01) |
| ***B22F 1/00*** | (2006.01) |
| ***B22F 9/12*** | (2006.01) |
| ***B22F 9/16*** | (2006.01) |
| ***H05H 1/00*** | (2006.01) |
| ***H05H 1/24*** | (2006.01) |

(52) U.S. Cl.
CPC ..... *C25C 1/20* (2013.01); *C25C 5/02* (2013.01); *C25C 7/00* (2013.01); *C25C 7/02* (2013.01); *H05H 1/00* (2013.01); *H05H 1/2406* (2013.01); *B22F 1/0014* (2013.01); *B22F 2301/255* (2013.01); *B22F 2999/00* (2013.01); *H05H 2001/2412* (2013.01); *H05H 2242/10* (2013.01); *H05H 2245/124* (2013.01)

(58) Field of Classification Search
CPC ..... B22F 9/12; B22F 9/16; B22F 2301/255; B22F 2999/00; H05H 1/00; H05H 1/2406; H05H 2001/2412–2468; H05H 2242/10; H05H 2245/124
See application file for complete search history.

(56) References Cited

U.S. PATENT DOCUMENTS

| | | | | |
|---|---|---|---|---|
| 8,540,942 | B2 | 9/2013 | Pierce et al. | |
| 2005/0066896 | A1* | 3/2005 | Viol | B08B 7/00 118/718 |
| 2005/0226802 | A1 | 10/2005 | Goodwin et al. | |
| 2006/0060464 | A1* | 3/2006 | Chang | H05H 1/2406 204/164 |

FOREIGN PATENT DOCUMENTS

| | | | |
|---|---|---|---|
| CN | 101032754 | A | 9/2007 |
| CN | 103567455 | A | 2/2014 |
| EP | 2424336 | A1 | 2/2012 |
| KR | 101406588 | B1 | 6/2014 |
| WO | 2012083442 | A1 | 6/2012 |

OTHER PUBLICATIONS

Chiang et al., "Continuous-flow, atmospheric-pressure microplasmas: a versatile source for metal nanoparticle synthesis in the gas or liquid phase," Plasma Sources Sci. Technol., vol. 19, 2010, 034011.
H. Furusho et al., "Preparation of Stable Water-Dispersible PEGylated Gold Nanoparticles Assisted by Nonequilibrium Atmospheric-Pressure Plasma Jets," Chem Mater. 2009; vol. 21, pp. 3526-3535.
D. Mariotti et al., "Microplasmas for nanomaterials synthesis," J Phys D Appl Phys., vol. 43, 2010, 323001.
I. G. Koo et al., "Platinum nanoparticles prepared by a plasma-chemical reduction method," Journal of Materials Chemistry, 2005, vol. 15, pp. 4125-4128.
A. Fridman et al., "Non-thermal atmospheric pressure discharges," Journal of Physics D: Applied Physics, vol. 38, 2005, R1-R24.
J. Xu et al., "Formation of hydrophobic coating on PMMA surface using unipolar nanosecond-pulse DBD in atmospheric air," Journal of Electrostatics, vol. 71, 2013, pp. 435-439.
K.G. Kostov et al., "Characteristics of dielectric barrier discharge reactor for material treatment," Brazilian Journal of Physics, vol. 39, No. 2, Jun. 2009, pp. 322-325.
S. W. Lee et al., "Fabrication of Ir nanoparti-cle-based biosensors by plasma electrochemical reduction for enzyme-free detection of hydrogen peroxide," Catalysis Today, vol. 211, 2013, pp. 137-142.
Extended European Search Report issued in EP Application No. 15868777.2, dated Aug. 8, 2018.
Communication pursuant to Article 94(3) EPC, dated Aug. 22, 2019 [citing D1 corresponding to previously cited KR101406588].

* cited by examiner

DIELECTRIC BARRIER DISCHARGE PLASMA METHOD AND APPARATUS FOR SYNTHESIZING METAL PARTICLES

RELATED PATENT APPLICATIONS

The present application is a national stage application under 35 U.S.C. § 371 of international patent application No. PCT/CA2015/051326, filed on Dec. 15, 2015, and which claims priority under 35 U.S.C. § 119(e) of U.S. provisional patent application No. 62/092,867, filed on Dec. 17, 2014. The above-referenced applications are hereby incorporated by reference into the present application in their entirety.

TECHNICAL FIELD

The general technical field relates to particle synthesis and, in particular, to a method and apparatus for synthesizing metal particles, for example nanoparticles, based on plasma-liquid electrochemistry techniques.

BACKGROUND

Plasma-based material synthesis and processing techniques are used in a large number of industrial applications. In recent years, advances in plasma electrochemistry have opened the possibility of synthesizing nanoparticles (and microparticles) by projecting an atmospheric-pressure plasma at the surface of a liquid containing metal ions from which the particles to be synthesized are composed (see, e.g., W.-H. Chiang et al., Plasma Sources Sci. Technol., vol. 19, no. 3, p. 034011, 2010; S. W. Lee et al., Catal. Today, vol. 211, p. 137-142, 2013). Metal nanoparticles (and microparticles) can be used in a number of applications, including catalysis, biomedical imaging, radiotherapy, optics and optoelectronics, paints, inks, coatings, and nanomedicine.

It is now generally recognized that plasma-liquid electrochemistry may allow nanoparticles to be synthesized not only more rapidly and efficiently than with conventional colloidal chemistry techniques, but also with environmentally-safer processes that limit the use of toxic chemicals as reducing agents. This is the case for nanoparticle synthesis processes involving metal ion reduction, where using plasmas allows the consumption of toxic or contaminating reducing agents (e.g., sodium citrate or sodium borohydride) to be decreased, or even avoided. In addition, by limiting the number of chemical species introduced in the metal precursor bath, nanoparticle suspensions with simpler chemical compositions and, in turn, improved colloidal stability can be produced.

These anticipated advantages have spawned a growing interest in developing atmospheric plasma-based techniques for synthesizing nanoparticles. One approach that has been investigated is based on atmospheric-pressure plasma reactors having submillimeter-sized hollow cathodes. However, while this approach may provide certain advantages, it also suffers from a number of drawbacks and limitations, among which are the practical limits on the size of the treatment area over which plasma homogeneity can be achieved, and the resulting difficulty of scaling up the plasma reactors to high-volume, continuous-flow and/or automated production.

Accordingly, various challenges still exist in the development of atmospheric plasma-based metal nanoparticle synthesis techniques capable of being scaled up to larger treatment areas while preserving adequate plasma homogeneity.

SUMMARY

According to an aspect of the invention, there is provided a method for synthesizing metal particles, including:

- providing a dielectric barrier discharge (DBD) plasma apparatus, the DBD plasma apparatus including an electrolyte vessel, an electrode spaced-apart from the electrolyte vessel, and a dielectric barrier interposed between the electrolyte vessel and the electrode;
- introducing an electrolyte solution including metal ions inside the electrolyte vessel, the electrolyte solution having an upper surface spaced-apart from the dielectric barrier;
- supplying gas into a discharge area extending between the upper surface of the electrolyte solution and the dielectric barrier; and
- applying an alternating or pulsed direct electrical potential difference between the electrode and the electrolyte solution, an amplitude of the electrical potential difference being sufficient to produce a plasma onto the electrolyte solution so as to interact with the metal ions and thereby synthesize the metal particles.

According to another aspect of the invention, there is provided a DBD plasma apparatus for synthesizing metal particles. The DBD plasma apparatus includes:

- an electrolyte vessel for receiving an electrolyte solution including metal ions;
- an electrode spaced-apart from the electrolyte vessel;
- a dielectric barrier interposed between the electrolyte vessel and the electrode such that, when the electrolyte solution is present in the electrolyte vessel, the dielectric barrier and an upper surface of the electrolyte solution are spaced-apart from each other and define a discharge area therebetween; and
- gas inlet and outlet ports in fluid communication with the discharge area such that, when the electrolyte solution is present in the electrolyte vessel, supplying gas in the discharge area while applying an alternating or pulsed direct electrical potential difference between the electrode and the electrolyte solution cause a plasma to be produced onto the electrolyte solution so as to interact with the metal ions and thereby synthesize the metal particles.

According to a further aspect of the invention, there is provided a use of the DBD plasma apparatus as defined above for synthesizing metal particles from metal ions contained in an electrolyte solution.

According to still another aspect of the invention, there is provided metal particles, for example metal nanoparticles but also metal microparticles, synthesized by the synthesis method as described herein.

In some implementations, the synthesized metal particles can be nanoparticles smaller than about 100 nanometers (nm) in diameter. For example, in an embodiment, the synthesized metal nanoparticles are between about 1 and 100 nm in diameter, in an alternative embodiment, the synthesized nanoparticles are between about 1 and 10 nm in diameter, and in a further embodiment, the synthesized nanoparticles are smaller than about 5 nm in diameter. In other implementations, the synthesized metal particles can be microparticles having a diameter in the range from about 0.1 to 100 micrometers (μm). For example, in an embodiment, the synthesized microparticles are in the submicron range (0.1-1 μm), and in an alternative embodiment, the particles are contained in the 1-100 μm range.

In some implementations, the electrolyte solution can include a surfactant in addition to the metal ions. In such implementations, the surfactant can prevent or reduce particle agglomeration in the electrolyte solution and, thus, limit the particle growth and favor their stabilization.

According to another general aspect, there is provided a method for synthesizing metal particles. The method comprises: providing a dielectric barrier discharge (DBD) plasma apparatus, the DBD plasma apparatus comprising an electrolyte vessel, an electrode spaced-apart from the electrolyte vessel, and a dielectric barrier interposed between the electrolyte vessel and the electrode; introducing an electrolyte solution comprising metal ions inside the electrolyte vessel, the electrolyte solution having an upper surface spaced-apart from the dielectric barrier; supplying gas into a discharge area extending between the upper surface of the electrolyte solution and the dielectric barrier; and applying an alternating or pulsed direct electrical potential difference between the electrode and the electrolyte solution, an amplitude of the electrical potential difference being sufficient to produce a plasma onto the electrolyte solution so as to interact with the metal ions and thereby synthesize the metal particles.

In an embodiment, supplying gas comprises continuously supplying the gas into the discharge area and evacuating gas therefrom.

In an embodiment, the introducing step further comprises conveying a flow of the electrolyte solution along an electrolyte flow path from an electrolyte inlet port to an electrolyte outlet port of the electrolyte vessel. The conveying step can comprise conveying the flow of the electrolyte solution a single time along the electrolyte flow path. Alternatively, the conveying step can comprise conveying the flow of the electrolyte solution multiple times along the electrolyte flow path. In still an alternative step, the introducing step can comprise introducing the electrolyte solution in the electrolyte vessel under a stagnant condition.

In an embodiment, the method further comprises cooling the electrode.

In an embodiment, the electrode is a liquid electrode contained in an electrode cell and the method further comprises: continuously conveying a liquid of the liquid electrode in the electrode cell. In an embodiment, the method further comprises evacuating heat from the DBD plasma apparatus through the continuously conveyed liquid of the liquid electrode. In an embodiment, at least a surface of the electrode cell is the dielectric barrier.

In an embodiment, the method further comprises continuously conveying a liquid in a liquid electrode cell located below the electrolyte solution contained in the electrolyte vessel.

In an embodiment, the method further comprises heating the electrolyte solution prior to introducing the electrolyte solution inside the electrolyte vessel.

In an embodiment, the alternating or pulsed direct electrical potential difference has a frequency ranging from about 1 kHz to about 100 kHz.

In an embodiment, the method further comprises monitoring and controlling a vertical gap between the upper surface of the electrolyte solution contained inside the electrolyte vessel and the dielectric barrier. Controlling the vertical gap can comprise adjusting a relative position of the electrolyte vessel and the dielectric barrier. Controlling the vertical gap can comprise adding electrolyte solution inside the electrolyte vessel. Controlling the vertical gap can also comprise increasing a flow of the electrolyte solution inside the electrolyte vessel. Controlling the vertical gap can include maintaining the vertical gap between about 1 mm to about 10 mm.

In an embodiment, the amplitude of the alternating or pulsed direct electrical potential difference is higher than about 1 kV.

In an embodiment, the method further comprises monitoring a temperature of the electrolyte solution inside the electrolyte vessel and controlling the temperature of the electrolyte solution between about 0° C. and about 95° C.

In an embodiment, the method further comprises monitoring pH of the electrolyte solution inside the electrolyte vessel and controlling the pH of the electrolyte solution between about 2 and about 7. Controlling the pH of the electrolyte solution can comprise adding a basic compound to the electrolyte solution prior to introducing the electrolyte solution inside the electrolyte vessel.

In an embodiment, the method further comprises monitoring in real-time a spectral response of the synthesized metal particles.

In an embodiment, the method further comprises adding a surfactant to the electrolyte solution and dissolving same prior to introducing the electrolyte solution inside the electrolyte vessel. The surfactant can be an electrostatic stabilizer, a steric stabilizer, or a mixture thereof.

In an embodiment, the plasma is atmospheric-pressure and non-thermal plasma.

In an embodiment, an electrical conduction of the electrolyte solution is sufficiently high to act as a counter-electrode and the method further comprises grounding the electrolyte solution.

In an embodiment, the method further comprises preparing the electrolyte solution by dissolving a metal ion precursor in a noninflammable solvent. The metal ion precursor can comprise metal chlorides, metal nitrates, metal acetates, organometallics, or mixtures thereof. The noninflammable solvent can be water-based. The synthesized metal particles can comprise Au, Pd, Pt, Ir, Os, Re, Ru, Rh, Ag, Ni, Cu, Fe, Mn, Co, or mixtures thereof.

In an embodiment, the metal ions comprise noble metal ions, transition metal ions, or mixtures thereof. The noble metal ions can comprise Au ions, Pd ions, Pt ions, Ir ions, Os ions, Re ions, Ru ions, Rh ions, Ag ions, or mixtures thereof. The transition metal ions can comprise Ni ions, Cu ions, Fe ions, Mn ions, Co ions, or mixtures thereof.

In an embodiment, the method further comprises supplying gas comprises supplying argon, helium, hydrogen, nitrogen, carbon dioxide, xenon, neon, air, water vapor, oxygen or a mixture thereof.

According to a further general aspect, there is provided a dielectric barrier discharge (DBD) plasma apparatus for synthesizing metal particles. The DBD plasma apparatus comprises: an electrolyte vessel for receiving an electrolyte solution comprising metal ions; an electrode spaced-apart from the electrolyte vessel; a dielectric barrier interposed between the electrolyte vessel and the electrode such that, when the electrolyte solution is present in the electrolyte vessel in a synthesis region thereof, the dielectric barrier and an upper surface of the electrolyte solution in the synthesis region are spaced-apart from each other and define a discharge area therebetween; and at least one gas inlet port and at least one outlet port in fluid communication with the discharge area such that, when the electrolyte solution is present in the electrolyte vessel, supplying gas in the discharge area while applying an alternating or pulsed direct electrical potential difference between the electrode and the electrolyte solution cause a plasma to be produced onto the electrolyte solution so as to interact with the metal ions and thereby synthesize the metal particles.

In an embodiment, the upper surface of the electrolyte solution and the dielectric barrier extend parallel and are separated from each other by a vertical gap when the electrolyte solution is contained in the electrolyte vessel. The vertical gap can have a height of about 1 mm to about 10 mm.

In an embodiment, the DBD plasma apparatus further comprises a vertical gap controller monitoring a distance between the upper surface of the electrolyte solution contained in the electrolyte vessel and the dielectric barrier. The vertical gap controller can be operable to control a level of the electrolyte solution in the electrolyte vessel. The vertical gap controller can be operable to control a vertical separation between the electrolyte vessel and the electrode.

In an embodiment, the electrode comprises a heat dissipation device. The heat dissipation device of the electrode can comprise a liquid-mass heat exchanger and/or heat-dissipation fins.

In an embodiment, the electrode comprises a metallic surface in contact with the dielectric barrier.

In an embodiment, the electrode is a liquid-based electrode. The liquid-based electrode can comprise an electrically conductive liquid contained in at least one liquid-containable cell. The at least one liquid-containable cell can comprise at least one glass-cell. The dielectric barrier can be a bottom surface of the at least one liquid-containable cell. The at least one liquid-containable cell can comprise a plurality of liquid-containable cells extending over the synthesis region of the electrolyte vessel. Bottom surfaces of the plurality of liquid-containable cells can be contiguous to define a substantially continuous dielectric barrier above the synthesis region of the electrolyte vessel. Each one of the at least one liquid-containable cell can comprise a cell port in fluid communication with a cooling liquid supply. The at least one cell port can be in fluid communication with a cell liquid output line to evacuate cooling liquid from the at least one liquid-containable cell and supply the at least one liquid-containable cell with cooling liquid from the cooling liquid supply. The DBD plasma apparatus can further comprise a cell liquid input line in fluid communication with the cooling liquid supply and defining a cell liquid flow path with the at least one liquid-containable cell and the cell liquid output line. The cooling liquid supply can be an electrically conductive liquid supply and the cooling liquid can be the electrically conductive liquid. The liquid-based electrode can further comprise at least one electrically-conducting element connectable to an electrical alternating power source to create the alternating or pulsed direct electrical potential difference, each one of the at least one electrically-conducting element being inserted in a respective one of the at least one liquid-containable cell. The at least one electrically-conducting element can extend over a substantial portion of a length of the respective one of the at least one liquid-containable cell. The at least one electrically-conducting element can comprise a plurality of electrically-conducting elements electrically connectable in parallel to the electrical alternating power source. The electrically conductive liquid can comprise water, a water-ethylene glycol mixture, or a water-oil emulsion with a low concentration of salt.

In an embodiment, the DBD plasma apparatus can further comprise a ground for grounding the electrolyte solution contained in the electrolyte vessel.

In an embodiment, the DBD plasma apparatus can further comprise a housing including a base and a removable mating cover, the base defining an electrolyte vessel receiving cavity and the electrolyte vessel being removably insertable in the electrolyte vessel receiving cavity of the housing. The at least one gas inlet port and the at least one gas outlet port can extend through the housing and can be in gas communication with the discharge area.

In an embodiment, a surface area of the electrode is substantially equal to a surface area of the synthesis region of the electrolyte vessel.

In an embodiment, the DBD plasma apparatus can further comprise a lower liquid electrode extending below the synthesis region of the electrolyte vessel. The lower liquid electrode can be separated by a dielectric barrier from the synthesis region of the electrolyte vessel. A surface area of the lower liquid electrode can be substantially equal to a surface area of the synthesis region of the electrolyte vessel. The lower liquid electrode can be in fluid communication with a cooling liquid supply through an electrode chamber inlet port.

In an embodiment, the electrolyte vessel comprises an electrolyte inlet port, an electrolyte outlet port, the electrolyte being configured to flow along an electrolyte flow path between the electrolyte inlet and the electrolyte outlet. The electrolyte outlet port can be defined by an upper edge of the electrolyte vessel. The DBD plasma apparatus can further comprise an electrolyte recovery gutter at least partially circumscribing the electrolyte vessel to recover an overflow of the electrolyte flowing outwardly of the electrolyte vessel through the electrolyte outlet port. The DBD plasma apparatus can further comprise a pump inducing an electrolyte flow along the electrolyte flow path. The DBD plasma apparatus can further comprise an inlet tubing line in fluid communication with the electrolyte inlet port, an outlet tubing line in fluid communication with the electrolyte outlet port, at least one of the inlet tubing line and the outlet tubing line being operatively connected to the pump to induce the electrolyte flow. The inlet tubing line, the outlet tubing line, the electrolyte flow path, and the pump can define an electrolyte closed-loop flow circuit. The electrolyte inlet port can be in fluid communication with an electrolyte supply. The electrolyte outlet port can be in fluid communication with an electrolyte collector.

The DBD plasma apparatus can further comprise an electrolyte heating device in fluid communication with the electrolyte inlet port of the electrolyte vessel and mounted upstream thereof.

In an embodiment, the electrolyte vessel is free of an electrolyte inlet port and an electrolyte outlet port and the electrolyte contained in the synthesis region is near stagnant.

In an embodiment, the electrolyte vessel is made of a material resistant to hydrochloric, sulfuric, nitric, and phosphoric acid corrosion resistance. The electrolyte vessel material can be made of polyolefin, fluoropolymer, a thermoplastic based material, or a combination thereof. The electrolyte vessel material can be selected from the group consisting of: high-density polyethylene (HDPE), polypropylene (PP), polytetrafluoroethylene (PTFE), glass-filled PTFE, ultra-high-molecular-weight UHMW polyethylene (PE), fluorinated ethylene propylene (FEP), perfluoroalkoxy alkanes (PFA), polyvinylidene fluoride (PVDF), polyether ether ketone (PEEK), polychlorotrifluoroethylene (PCTFE), ethylene chlorotrifluoroethylene (ECTFE), ethylene tetrafluoroethylene (ETFE), and a combination thereof.

In an embodiment, the at least one gas inlet port is connectable to at least one gas supply unit containing argon, helium, $N_2$, $H_2$, $NH_3$, carbon dioxide, xenon, neon, air, water vapor, oxygen or mixture thereof.

In an embodiment, the gas is continuously supplied to and evacuated from the discharge area through the at least one gas inlet port and at least one outlet port.

In an embodiment, the DBD plasma apparatus further comprises a temperature control device including at least one temperature probe configured to monitor an electrolyte temperature, at least one of the temperature probe including a metal cladding in contact with the electrolyte contained in the electrolyte vessel and electrically grounding same to earth.

In an embodiment, the DBD plasma apparatus further comprises a pH control device including at least one pH probe configured to monitor a pH of the electrolyte.

In an embodiment, the DBD plasma apparatus further comprises a spectroscopy cell in fluid communication with the electrolyte vessel, mounted downstream of the electrolyte output port.

In an embodiment, the DBD plasma apparatus further comprises the electrolyte vessel is free of metallic electrode in contact with electrolyte contained in the synthesis region.

According to still another general aspect, there is provided the use of the DBD plasma apparatus described above for synthesizing metal particles from metal ions contained in an electrolyte solution. The metal particles can comprise Au, Pd, Pt, Ir, Os, Re, Ru, Rh, Ag, Ni, Cu, Fe, Mn, Co, or mixtures thereof. The metal ions can comprise noble metal ions, transition metal ions, or mixtures thereof. The noble metal ions can comprise Au ions, Pd ions, Pt ions, Ir ions, Os ions, Re ions, Ru ions, Rh ions, Ag ions, or mixtures thereof. The transition metal ions can comprise Ni ions, Cu ions, Fe ions, Mn ions, Co ions, or mixtures thereof. The electrolyte solution can bean aqueous-based solution. The electrolyte solution can comprise a surfactant.

According to still another general aspect, there is provided metal particles synthesized by the method described above. In an embodiment, the metal particles are nanoparticles smaller than about 100 nm in diameter.

Other features and advantages of aspects of the present invention will be better understood upon reading of preferred embodiments thereof with reference to the appended drawings.

BRIEF DESCRIPTION OF THE DRAWINGS

FIG. 13A illustrates the initial color of the electrolyte solution before the nanoparticle synthesis process (syntheses S1 and S3 to S11; gold nanoparticles). FIG. 13B (syntheses S1 and S4 to S6; gold nanoparticles) and 13C (synthesis S2; palladium nanoparticles) illustrate the final color of the electrolyte solution.

DETAILED DESCRIPTION

Figure 1:
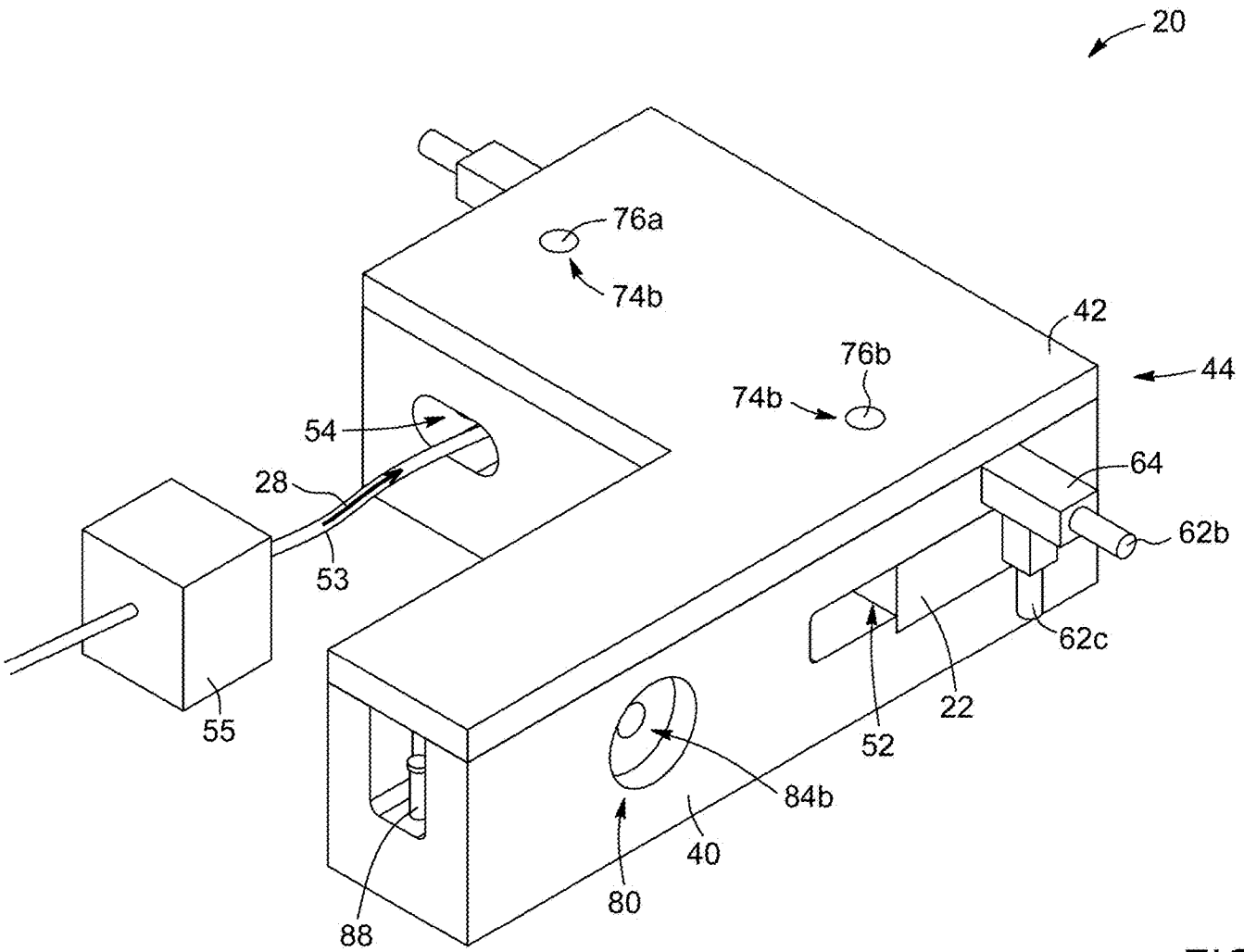
FIG. 1 is a schematic perspective view of a DBD plasma apparatus, in accordance with an exemplary embodiment.

In the following description, similar features in the drawings have been given similar reference numerals, and, in order to not unduly encumber the figures, some elements may not be indicated on some figures if they were already identified in preceding figures. It should also be understood herein that the elements of the drawings are not necessarily depicted to scale, since emphasis is placed upon clearly illustrating the elements and structures of the present embodiments.

The present description generally relates to a plasma-liquid electrochemistry method and apparatus for synthesizing metal particle suspensions from electrolyte solutions containing metals ions and, optionally, a surfactant. The plasma-based nanoparticle synthesis techniques described herein involve the generation of an atmospheric-pressure, non-thermal, DBD plasma directed directly at the surface of an electrolyte solution containing metal ions. In the plasma, reactive species in the plasma, such as electrons and negative ions, are projected toward the interface of the plasma with the electrolyte solution, where they reduce the metal ions and, thus, induce the nucleation and growth of metal particles.

Throughout the present description, the term "metal particles" refers not only to the metal itself but also to other metal compounds such as metal oxides, metal hydroxides, metal phosphates, metal carbonates, metal sulfides, metal nitrides, metal carbides, and the like. Therefore, as used herein, the term "metal particles" is meant to encompass not only metal particles but also particles of metal compounds.

In general, the size of the synthesized metal particles lies in the nanoparticle or microparticle range. As used herein, the term "nanoparticle" may be used to refer to a particle having an average particle size that can be measured on a nanoscale. For example, in a non-limitative embodiment, the synthesized nanoparticles can be smaller than about 100 nm in diameter, or between about 1 and 100 nm in diameter, or between about 1 and 10 nm in diameter, or smaller than about 5 nm in diameter. As also used herein, the term "microparticle" may be used to refer to a particle having an average particle size that can be measured on a microscale. For example, in a non-limitative embodiment, the synthesized microparticles can be between about 0.1 to 100 μm in a diameter, or between about 0.1 and 1 μm in diameter, or between 1 and 100 μm in diameter. In this regard, those skilled in the art will recognize that the definitions of the terms "nanoparticle" and "microparticle" in terms of size range, as well as the dividing line between the two terms, can vary depending on the technical field under consideration, and are not meant to limit the scope of applications of the techniques described herein.

The techniques described herein can be used in the production of metal particle suspensions, for example nanoparticle suspensions, as well as in processes requiring the precipitation of a variety of metal ions from aqueous suspensions. More particularly, the present techniques may be useful in a number of applications including, without being limited to, (a) removal of metal ions from industrial effluents for extractive metallurgy applications, (b) recovery of valuable metals from acid suspensions without cyanidation, (c) rapid synthesis of gold, silver, palladium, platinum, rhodium, rhenium, ruthenium, iridium, osmium and copper nanoparticles for industrial and biomedical applications, (d) rapid synthesis of radioactive gold and palladium nanoparticles for internal radiation therapy applications, and (e) recovery of radioactive ions dissolved in aqueous suspensions, through precipitation and recovery of synthesized nanoparticles.

Broadly described, the method for synthesizing metal particles includes a first step of providing a DBD plasma apparatus. By way of example, the DBD plasma apparatus can be implemented as the one described below with reference to FIGS. 1 to 9 or as a similar apparatus. As schematically illustrated in FIG. 10, the DBD plasma apparatus 20 includes at least an electrolyte vessel 22, an electrode 24 spaced-apart from the electrolyte vessel 22, and a dielectric barrier 26 interposed between the electrolyte vessel 22 and the electrode 24. Those skilled in the art will recognize that the method described herein is applicable to any DBD plasma apparatus capable of performing the appropriate method steps. The method also involves a step of introducing an electrolyte solution 28 including metal ions, and optionally a surfactant, inside the electrolyte vessel 22, and a step of supplying gas 30 (schematically represented by an arrow) into a discharge area 32 extending between an upper surface 34 of the electrolyte solution 28 and the dielectric barrier 26 and defining a gap 56. It is to be noted that the discharge area 32 may also be referred herein to as a "plasma treatment area". It is understood that the discharge area 32 corresponds to a volume defined between the upper surface 34 of the electrolyte solution 28, the dielectric barrier 26, and a synthesis region 48 of the electrolyte vessel 22 within which the synthesis of metal particles takes place. The method further includes a step of applying an alternating or pulsed direct electrical potential difference between the electrode 24 and the electrolyte solution 28. The applying step can involve connecting an electrical power source 36 to the electrode 24 and grounding the electrolyte solution 28 with a ground 37. The electrical potential difference, generated by the electrical power source 36, is of sufficient amplitude to generate a plasma 38 in the discharge area 32 and onto the electrolyte solution 28. The plasma 38 interacts with the metal ions in the electrolyte solution 28 to synthesize metal particles.

It will be appreciated that the techniques described herein provide a DBD plasma apparatus that includes only an upper electrode, as the electrolyte solution present in the electrolyte vessel is sufficiently conductive to act as a counter-electrode in the plasma process (i.e., the lower electrode). More detail regarding the benefits of using the electrolyte solution itself as an electrode in DBD plasma technology applied to metal particle synthesis, will be discussed further below.

In an embodiment, the DBD plasma apparatus includes not only a liquid-based lower electrode, but also a liquid-based upper electrode whose liquid content can be continuously recycled for heat dissipation purposes. Therefore, in an embodiment, a versatile DBD plasma apparatus with two liquid-based electrodes is provided so that the DBD plasma apparatus is designed to allow a highly uniform plasma to be generated over a large and upscalable treatment area.

In some implementations, the electrolyte solution containing the metal ions can be an aqueous electrolyte solution, obtained by dissolving a metal ion precursor, and optionally a surfactant, in pure water. However, those skilled in the art will appreciate that the electrolyte solution can be any suitable noninflammable electrolyte solution. The electrolyte solution can be a liquid electrolyte solution to ensure sufficiently rapid particle and heat diffusion. Those skilled in the art will also recognize that various metal ion precursors can be used, including, without being limited to, metal chlorides, metal nitrates, metal acetates, metal organometallics, and mixtures thereof.

As used herein, the term "metal ion" refers broadly to any metal ion that can be used for synthesizing metal nanoparticles, which can include, without being limited to, noble metal ions such as, for example gold ($Au^{+}$, $Au^{3+}$, $AuCl^{4-}$), palladium ($Pd^{2+}$, $PdCl_4^{2-}$, $PdBr_4^{2-}$), platinum ($Pt^{2+}$, $PtCl_6^{2-}$, $PtCl_4^{2-}$), iridium ($IrCl_6^{3-}$), osmium, rhenium ($Re^{3+}$), ruthenium ($Ru^{3+}$), rhodium ($RhCl_6^{3-}$) and silver ($Ag^{+}$), and transition metal ions such as, for example, nickel, copper ($Cu^{2+}$), iron, manganese, and cobalt. Other possible types of metal ions, in particular those having standard electrochemical reduction potentials in the positive range, are listed in the *Handbook of Chemistry and Physics*, edited by R. C. Weast (CRC Press, Boca Raton, Fla., 1979-1980), vol. 60, pages D-155-157, which is incorporated herein by reference.

In some implementations, the electrolyte solution can include a surfactant in addition to the metal ions. The provision of a surfactant can prevent particle agglomeration in the electrolyte solution and limit the particle growth. The surfactant can be an electrostatic stabilizer having either positive or negative surface charges, or a steric stabilizer covering the synthesized particles with polymers. The surfactant can be a molecule, such as a surfactant or a surface ligand, which is added to the reactive bath to prevent particle coalescence and aggregation. For example, and without being limitative, the surfactant can include at least one of carboxylic acids, acid halides, amines, acid anhydrides, activated esters, maleimides, isothiocyanates, acetylacetonates, silica precursors, a polyphosphate (e.g., calcium pholyphophates), an amino acid (e.g., cysteine), an organic polymer (e.g., polyethylene glycol/PEG, polyvinyl alcohol/PVA, polyamide, polyacrylate, polyurea), an organic functional polymer (e.g., 1,2-distearoyl-sn-glycero-3-phosphoethanolamine-N-[carboxy(polyethylene glycol)2000] ammonium salt), a biopolymer (e.g., polysaccharide like dextran, xylan, glycogen, pectin, cellulose or polypeptide like collagen, globulin), cysteine, a peptide with high cysteine content and a phospholipid. In a non-limitative exemplary embodiment, the surfactant is fructose, dextran, polyethylene glycol, dimercaptosuccinic acid (DMSA) or citric acid. It is to be emphasized that in some implementations of the techniques described herein, for example and without being limitative in some extractive metallurgy applications, the use of a surfactant may not be desirable and/or required. For example, in some cases, it can be disadvantageous to limit the particle growth, for example for the synthesis of metal microparticles or for metal precipitation procedures. Therefore, in some implementations, surfactants are mainly used to stabilize the colloidal suspension of nanoparticles, and also to control nanoparticle growth.

In plasma-based nanoparticle synthesis according to the techniques described herein, the plasma is generated at atmospheric pressure and acts as an reactive species supply, such as an electron supply, at the plasma-liquid interface. The plasma can be generated from argon, helium, hydrogen, nitrogen, carbon dioxide, xenon, neon, air, water vapor, oxygen or any other suitable gas or gas mixture. The mechanism of nanoparticle nucleation and growth involves at least an interaction between the reactive species in the plasma and chemical species in the electrolyte solution, leading to the nucleation of metal-containing nanoparticles, and possibly one or more of the following steps:

(a) an intermediate step taking place in the electrolyte solution, in which the metal ions bind to, for example, oxygen species, thereby forming nanoparticles with a high content in metallic elements (e.g., metal oxide, metal hydroxide or metal phosphate nanoparticles having a significant metallic element content); and/or (b) an intermediate step taking place at the interface of the electrolyte solution, where the reactive gas (e.g., $N_2$, or $H_2$ or $CO_2$), either used to generate the plasma or as a contaminant gas, interacts with the nucleation and growth process by changing the pH of the electrolyte solution; and/or (c) an intermediate step taking place at the interface of the electrolyte solution, where the reactive gas (e.g., $N_2$, or $H_2$ or $CO_2$), either used to generate the plasma or as a contaminant gas, interacts with the nucleation and growth process by changing the chemistry and reaction efficiency of the nanoparticle synthesis process.

In an embodiment, the process allows fine, substantially uncontaminated nanoparticles made of metal elements (for example, but not limited to: Au, Ag, Pd, Pd, Rh, Ru, Re, Ir, Os, Cu) to be efficiently nucleated and grown within minutes, with high conversion rates of metal ions to metal nanoparticles, and good temperature regulation in the plasma reactor. In an embodiment, the growth of the nanoparticles can be monitored in situ, for example using an integrated UV-visible spectrometer.

In an embodiment, the plasma-based particle synthesis process is carried out as a multi-pass or recycle, continuous-flow process, and in an alternative embodiment, the plasma-based particle synthesis process is carried out as single-pass, continuous flow process. In another alternative embodiment, the plasma-based particle synthesis process is carried out as a batch process.

In recent years, DBD plasma systems have emerged as an economic and reliable way to generate non-equilibrium, atmospheric-pressure plasmas on large treatment areas, and have opened the door to various new chemical and electrochemical process routes. This has made DBD plasma technology attractive for use in a number of emerging industrial applications in fields such as industrial ozone generation, surface modification of polymers, plasma-chemical vapor deposition, pollution control, excitation of $CO_2$ lasers, excimer lamps, and air-flow control.

In the techniques described herein, DBD plasma technology has been adapted to the synthesis of metal particles, due notably to its capability of being scaled-up to larger plasma-liquid surfaces and used in both batch and continuous-flow applications. More detail regarding some of the reasons behind the use of DBD plasma technology in the techniques described herein will now be provided.

First, it is known in the art that supplying energy to a gas in an amount sufficient to ionize its molecules or atoms can lead to the generation of a plasma. A plasma consists in a macroscopically relatively uniform mixture of electrons, ions (mostly positive) and remaining neutral molecules or atoms in an excited or fundamental state. In artificial or man-made plasmas, the energy is usually supplied by the application of an electrical field on a gas, in which case the underlying ionization process at play is generally the Townsend avalanche. A state in which electrical energy is supplied in a well-controlled manner and the plasma has reached a steady state with well-defined parameters (e.g., in terms of ionization level and temperature) is referred to as a "plasma discharge".

A notable difference between atmospheric-pressure plasma discharges (APPDs) and their low-pressure counterparts is that APPDs generally have a strong tendency to arc. As known in the art, an arc is a self-confined discharge. When the density of electric charges (i.e., both electrons and ions) is high enough and their collective movement is fast and directional enough, a magnetic field is created that tends to bring the flowing charges closer to one another. This, in turn, leads to an increase in the probability of collisions between the moving charges and the neutral gas (and hence in the ionization rate), but also to a decrease in the probability of collisions between those moving charges and the solid surfaces present in the system (and hence in the neutralization rate). As a result, the charge density increases substantially and the initial preferential direction of movement is enforced, resulting in an even stronger magnetic field. This stronger magnetic field exacerbates the sequence of phenomena just described until the plasma discharge is confined to a thin line, referred to as an "arc". Arcing tends to arise more easily at atmospheric pressure because, in this case, gas molecules are closer to one another and thus are much more likely to collide with one another than with surfaces of the system. Furthermore, although ionization may be more difficult to achieve at atmospheric pressure, it tends, however, to increase more rapidly once a certain energy threshold is reached and be localized in small areas. In such conditions, the plasma discharges tend to be confined into arcs.

Arcing is generally considered to be a detrimental and undesirable phenomenon, which is to be avoided or overcome when designing plasma generators aimed at treating relatively large surfaces with a sufficiently homogeneous and stable plasma. A number of approaches exist that can be used to handle the arcing tendency of atmospheric-pressure plasmas.

A first approach aims to benefit from arcing by designing robust systems capable of sustaining and resisting to the high current generated by one or a few high-intensity arcs. These so-called "arc plasmas" are classified in the category of plasmas known as "hot plasmas". Arc plasmas are known for their metal cutting and welding abilities, and are used in the melting and spraying of refractory materials. However, they are not well suited for surface treatment of low-melting-point materials involving specific chemical reactions or for pure processes, as arcing tends to induce sputtering of the electrode material.

A second approach attempts to prevent arcing altogether. For example, this can be done through geometric confinement of the plasma discharge inside a small, submillimeter structure, which then becomes equivalent to a low-pressure system where plasma-wall interactions are sufficiently important to prevent arc formation. Needle-like atmospheric-pressure plasma reactors with submillimeter-sized hollow cathodes are based on this approach.

A third approach involves limiting the duration and energy of small arcs, which are generally numerous and randomly distributed when the plasma treatment area extends over a relatively large surface. In some scenarios, the limit can be geometrical. This is the case with corona discharge plasma generators, in which the high-voltage electrode is located sufficiently far from the counter-electrode that micro-arcs initiated at the high-voltage electrode self-extinguish before reaching the counter-electrode. In other scenarios, the limit can be temporal, in which case micro-arcs are allowed to form but are actively extinguished before acquiring too much energy. DBD plasma reactors fall into this category and limit the development of arcs by electrically insulating two spaced-apart, parallel electrodes between which an alternating voltage of sufficient frequency and amplitude is applied. Capacitive effects allow micro-arcs to form but charges accumulating at the surfaces of the dielectric barrier adjacent the electrodes rapidly and efficiently cancel the applied electric field, thus extinguishing the micro-arcs. This cycle repeats itself at every half period of the alternating voltage. This type of DBD can be referred to as "filamentary".

Plasmas generated by DBD can be classified as "cold plasmas" due to the fact that it is the electrons that carry most of the energy, while the ions and neutrals remain close to room temperature. DBD plasma discharges also tend to be self-stabilizing, in that they act to extinguish the micro-arcs described in the previous paragraph. DBD plasma systems have been used in various industries for the rapid treatment of large surfaces of polymers when uniformity at the microscopic level is not an issue. DBD plasma systems used to generate plasma directed at a liquid surface have also been investigated. DBD plasma technology allows atmospheric-pressure, non-thermal plasmas to be generated over relatively large areas in a reliable and effective way. However, its adaptation for use in high-throughput particle suspension synthesis from liquid electrolyte solutions is not straightforward and involves various challenges.

For example, in order to preserve the chemical integrity and purity of the metal particle suspensions generated from the electrolyte solution containing metal ions, the DBD plasma reactor should, in some scenarios, be designed so that contacts between the metal particle suspension and metal surfaces in the generator are minimized, or even avoided. Such a design constraint renders the presence of a metal electrode in the electrolyte solution undesirable or detrimental. However, existing plasma-liquid electrochemistry techniques developed for particle synthesis applications do, in fact, include a metal counter-electrode in the liquid to be treated. This can lead to a number of disadvantages, including (a) contamination of the liquid by sputtered electrode material, (b) chemical composition of the synthesized particles limited to that of the electrode material, and (c) difficulty in obtaining a homogeneous plasma treatment over a large area due to the localized and finite-size nature of the counter-electrode immersed in the liquid.

In order to address these issues, and as briefly mentioned above, the techniques described herein provide a DBD plasma apparatus in which the electrolyte solution itself acts as a counter-electrode, thereby allowing a homogeneous plasma to be generated over a large and upscalable treatment area. The DBD plasma apparatus is designed to reduce/minimize contacts between the metal particle suspension and metal surfaces in the generator. In the above-described embodiment, a metallic thermocouple used to monitor a temperature of the electrolyte solution and to electrically ground the electrolyte solution is in contact with the electrolyte solution.

However, the surface area of contact between the electrolyte solution and the thermocouple electrode is relatively small, in comparison with a surface area of the synthesis region, and contamination of the electrolyte solution is minimized. Thus, given the absence of a metal counter-electrode in the electrolyte solution to be treated and minimal contact between the electrolyte solution and an electrode used to ground the electrolyte solution, the proposed design contributes to minimizing the contamination of the particle suspension and allows synthesizing metal particles whose chemical composition is not tied to that of a metal counter-electrode immersed in the reaction vessel.

With general reference to FIGS. 1 to 9, there is illustrated a non-limitative exemplary embodiment of a DBD plasma apparatus 20 for synthesizing a metal particle suspension from an electrolyte solution 28 containing metal ions. It is to be noted that, for convenience, the expression "DBD plasma apparatus" may in some instances be shortened to "DBD apparatus", "plasma apparatus" or simply "apparatus".

Figure 2:
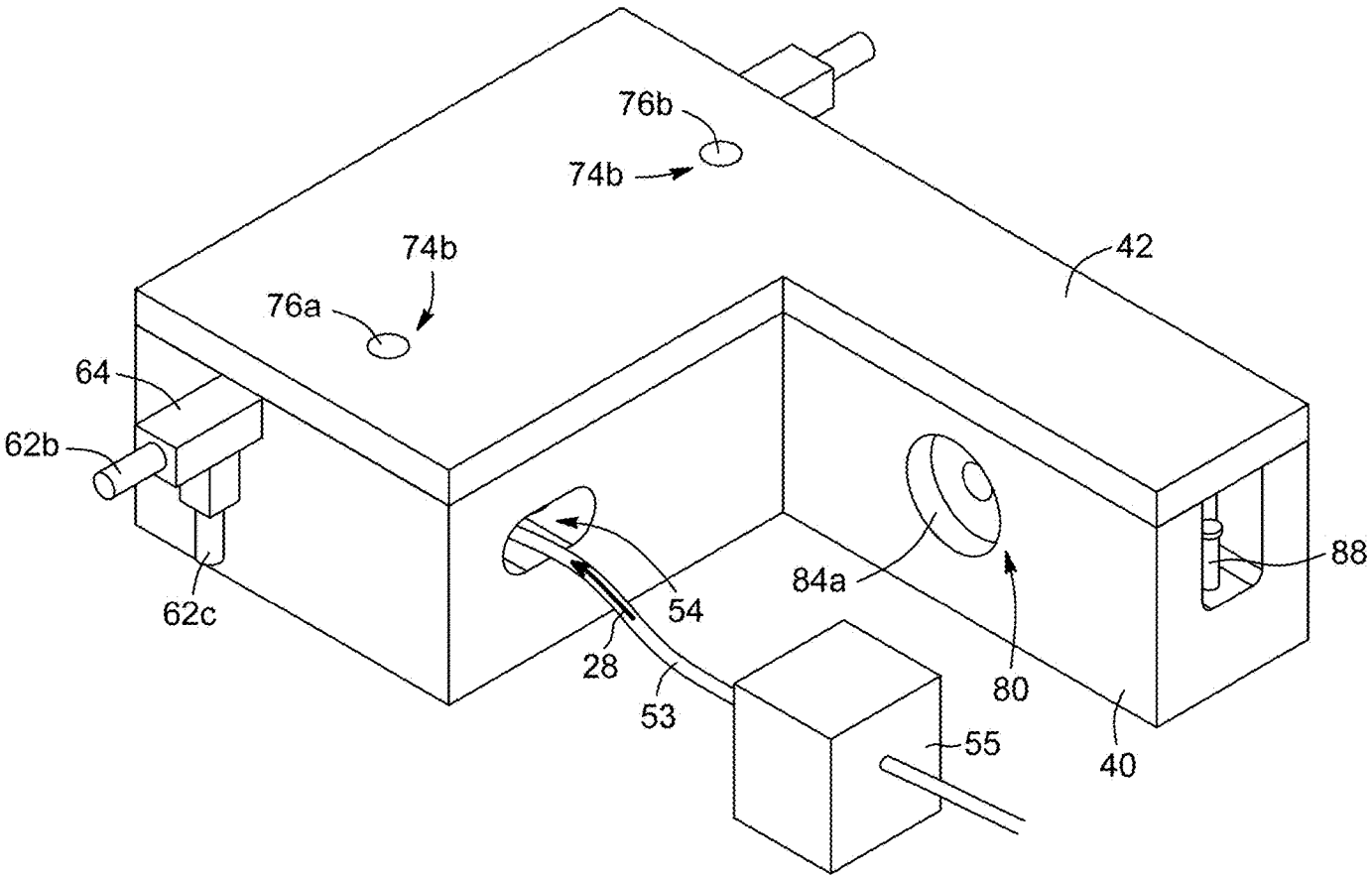
FIG. 2 is another schematic perspective view of the DBD plasma apparatus of FIG. 1.
Figure 3:
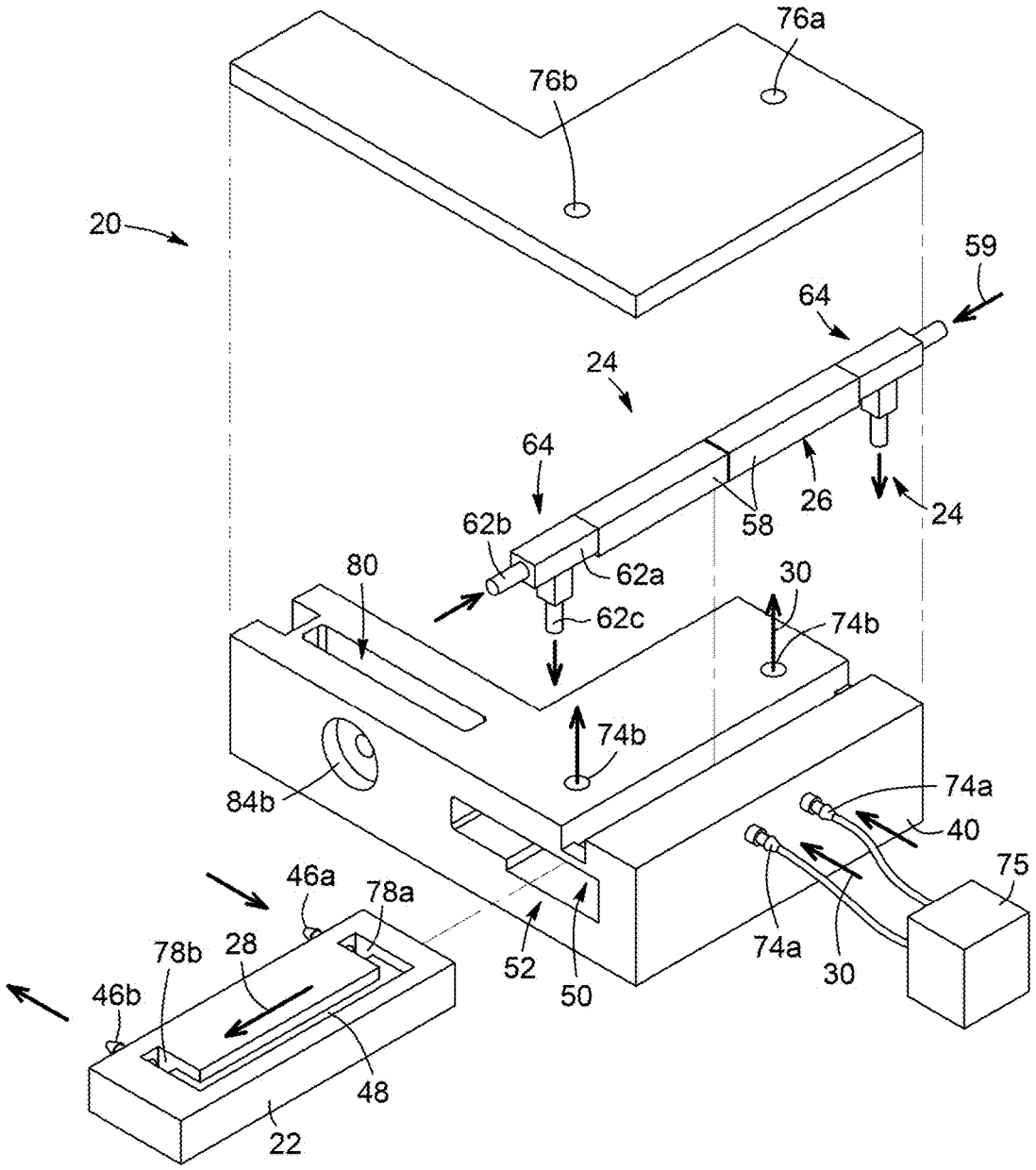
FIG. 3 is a schematic, partially exploded perspective view of the DBD plasma apparatus of FIG. 1, depicting the removal of the cover, the electrolyte vessel and the electrode from the base.

As depicted in FIGS. 1 to 3, the DBD apparatus 20 can include a base 40 and a mating or matching cover 42. The base 40 and the cover 42 together define an external housing 44 of the DBD apparatus 20 for accommodating, housing or otherwise mechanically supporting the different components of the DBD plasma apparatus 20 described below. In the illustrated embodiment, the base 40 and the cover 42 are machined from a 22×16×7 $cm^3$ high-density polyethylene (HDPE) block, but other non-metallic materials, such as but not limited to polypropylene (PP), polytetrafluoroethylene (PTFE) and glass-filled PTFE, are encompassed. In addition, different shapes and dimensions can be used in other embodiments.

The provision of an enclosed and compact DBD apparatus 20 offers a number of advantages, including (a) limiting gas leaks from the plasma treatment area, (b) protecting the users from the high-tension electrodes, (c) limiting entry of light which could interfere with UV-visible spectroscopic data acquisition, (d) limiting atmospheric contamination of the plasma treatment area, and (e) portability and versatility.

Figure 4:
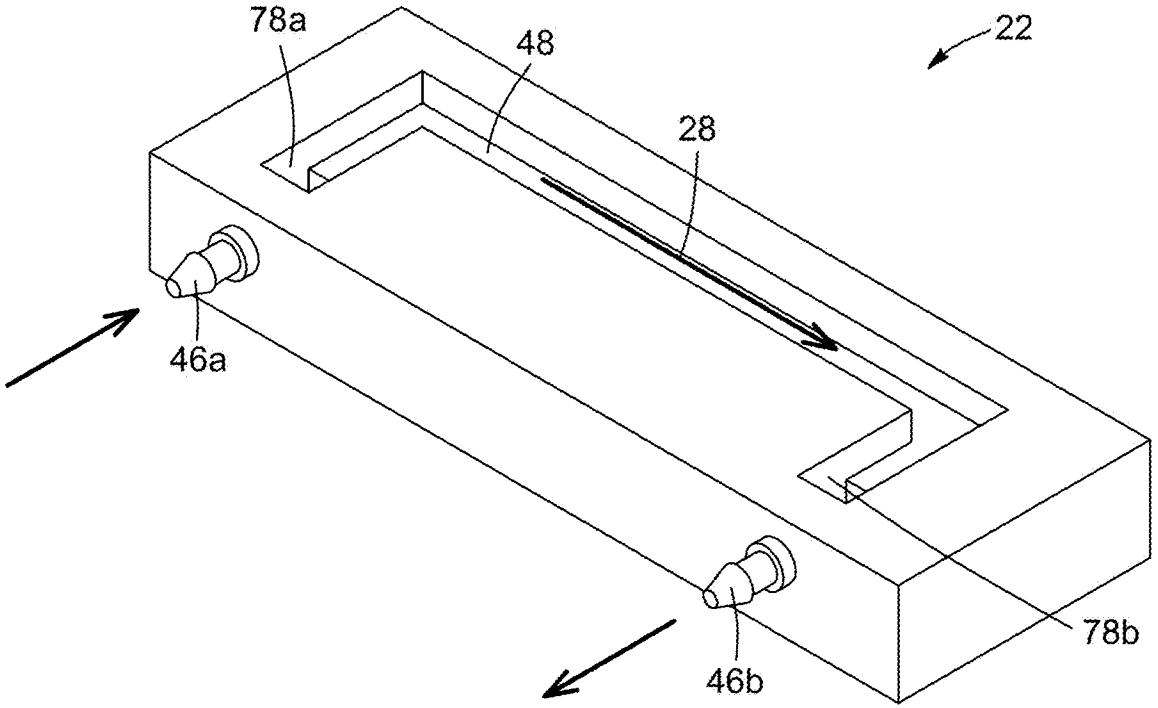
FIG. 4 is a schematic, perspective view of the electrolyte vessel of the DBD plasma apparatus of FIG. 1. The flow path of the electrolyte solution in the electrolyte vessel is depicted by arrows.
Figure 7:
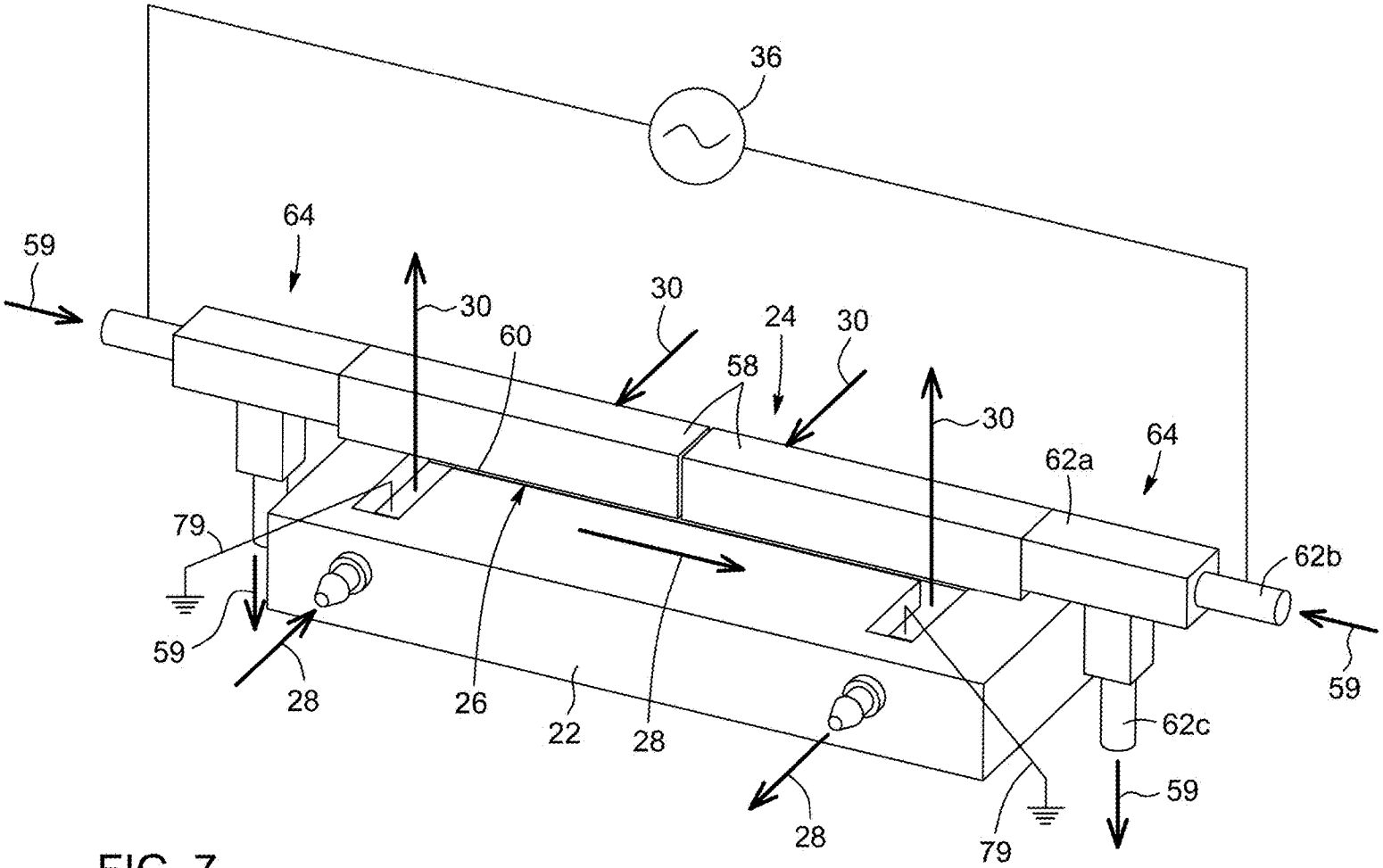
FIG. 7 is a schematic, partial perspective view of the DBD plasma apparatus of FIG. 1, detailing the configuration of the electrode and the underlying electrolyte vessel. The flow paths of the electrolyte solution, gas and cooling liquid are depicted by arrows.

Turning to FIGS. 3, 4 and 7, the DBD plasma apparatus 20 includes an electrolyte vessel 22 for receiving the electrolyte solution 28 containing the metal ions. In the illustrated embodiment, the electrolyte vessel 22 is provided as a removable cartridge machined from a HDPE block, but other materials, shapes and dimensions can be used in other embodiments. For instance, the electrolyte vessel 22 can be made of any suitable synthetic polymer material. For example, suitable materials for the electrolyte vessel 22 can include, without being limitative, polyolefins such as HDPE, ultra-high-molecular-weight UHMW polyethylene (PE) and polypropylene (PP), fluoropolymers such as PTFE, fluorinated ethylene propylene (FEP), perfluoroalkoxy alkanes (PFA), polyvinylidene fluoride (PVDF), polychlorotrifluoroethylene (PCTFE), ethylene chlorotrifluoroethylene (ECTFE), ethylene tetrafluoroethylene (ETFE), and the like, and other thermoplastics such as polyether ether ketone (PEEK), which have excellent to good corrosion resistance to hydrochloric, sulfuric, nitric, and phosphoric acids.

The electrolyte vessel 22 includes an electrolyte inlet port 46*a* and an electrolyte outlet port 46*b* through which the electrolyte solution 28 can enter in and exits from the electrolyte vessel 22, respectively, and the synthesis region 48 within which the synthesis of metal particles takes place. The electrolyte inlet and outlet ports 46*a*, 46*b* may each be provided with an appropriate connector element (e.g., a PVDF connector commercially available from Cole-Parmer™) for connection with tubing, such as tubing line 53 (see FIG. 1). In the illustrated embodiment, the synthesis region 48 is embodied as a vertical trench and defines an electrolyte flow path extending between the electrolyte inlet and outlet ports 46*a*, 46*b*. Of course, the shape and configuration of the synthesis region 48 may differ in other embodiments.

In FIGS. 3, 4 and 7, the flow path of the electrolyte solution 28 in the electrolyte vessel 22 is depicted by arrows. In the illustrated embodiment, because the electrolyte solution 28 flows inside the synthesis region 48, the plasma-based particle synthesis process is said to be carried out as a continuous-flow process, which can either be operated in single-pass mode, where the electrolyte solution 28 flows only once between the electrolyte inlet and outlet ports 46*a*, 46*b*, or in a multiple-pass or recycle mode, where the electrolyte solution 28 flows more than once between the electrolyte inlet and outlet ports 46*a*, 46*b*. However, in another embodiment, the plasma-based particle synthesis process is carried out as a batch process, where the electrolyte solution 28 is stagnant or near stagnant. For a DBD plasma apparatus conceived for batch processes, the electrolyte vessel 22 can be free of electrolyte inlet and outlet ports 46*a*, 46*b* in fluid communication with the synthesis region.

In some implementations wherein the DBD plasma apparatus is operated in single-pass mode or in multiple-pass mode, the DBD plasma apparatus is envisioned to process up to 1 ton per hour of electrolyte solution. In some implementations, the DBD plasma apparatus is envisioned to operate with a flow of electrolyte solution comprised between 15 and 100 L/h.

Referring still to FIGS. 3, 4 and 7, in an embodiment, the electrolyte vessel 22 is the only HDPE component of the DBD apparatus 20 that is in contact with the electrolyte solution 28, which helps protecting the other HDPE components of the apparatus 20 from any damage or wear that might be caused by the acidity of the electrolyte solution 28. Advantageously, the base 40 can define a cavity 50 for accommodating the electrolyte vessel 22 as well as an opening 52 leading into the cavity 50 and allowing the electrolyte vessel 22 to be quickly and conveniently pulled out from and replaced in the cavity 50, thus reducing contamination risks between two synthesis procedures.

Referring to FIG. 1, in an embodiment, the electrolyte solution 28 can be introduced in the electrolyte vessel 22 by being pumped along the tubing line 53 connectable to the electrolyte inlet port 46*a* via another dedicated opening 54 defined in the base 40. The tubing line 53 may be made of silicone or another material with appropriate chemical resistance to the electrolyte solution 28. In some implementations, the tubing line 53 may pass through an external heating device 55, for example a microwave heating device, to bring the electrolyte solution 28 to a certain desired temperature prior to entering the electrolyte vessel 22 and synthesizing particles. In some non-limitative embodiments, the temperature of the electrolyte solution 28 may be maintained to a fixed temperature in the range between about 0 to 95° C. In some implementations, the temperature of the electrolyte solution is maintained to a fixed temperature in the range between about 20 and 90° C. In some further implementations, the temperature of the electrolyte solution is maintained to a fixed temperature in the range between about 20 and 70° C. In other implementations, the temperature of the electrolyte solution is varied in one of the ranges detailed above.

Figure 5:
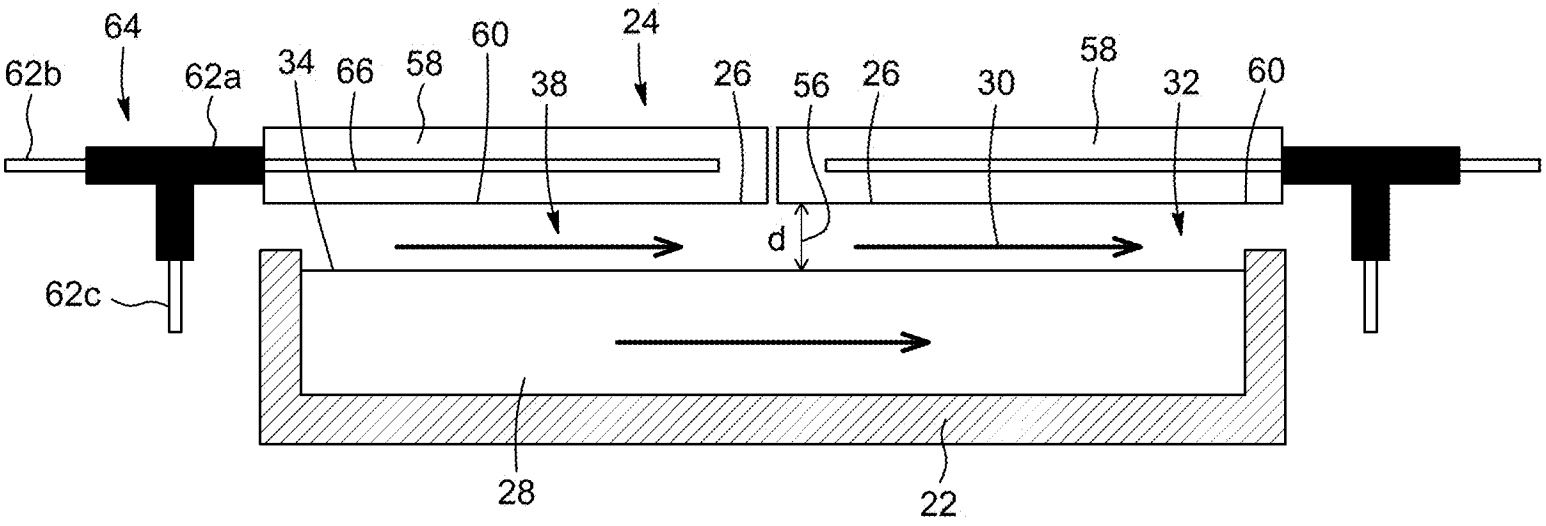
FIG. 5 is a schematic, partial cross-sectional view of the DBD plasma apparatus of FIG. 1, detailing the plasma treatment area.

Referring now to FIGS. 3, 5 and 7, the DBD plasma apparatus 20 further includes an electrode 24 over and spaced-apart from the electrolyte vessel 22, as well as a dielectric barrier 26 interposed between the electrolyte vessel 22 and the electrode 24. The dielectric barrier 26 can be made of any suitable material with electric insulating properties. For instance, suitable materials include metallic oxides or refractory materials, such as $ZrO_2$, $Al_2O_3$ and $SiO_2$, and polymeric materials, such as polytetrafluoroethylene (PTFE) can be used as dielectric barrier 26. In some implementations, the dielectric constant (or relative permittivity) of the material of the dielectric barrier is comprised between 2 and 200 with electrical and thermal characteristics corresponding roughly to those of the dielectrics of Class I ceramic capacitors. In some implementations, the dielectric material should satisfy the following requirements:

- the dielectric strength is superior to 10 kV/mm;
- the dissipation factor (DF) is inferior to 0.1% at the working frequency;
- the thermal coefficient is inferior to +/−0.1%/degree C.; and
- the chemical resistance to the solution and the resistance to sputtering by the plasma is satisfactory i.e. the resulting impurity concentration is substantially negligible.

The configuration of the electrolyte vessel 22, electrode 24 and dielectric barrier 26 is such that, when the electrolyte solution 28 is present in the electrolyte vessel 22, the dielectric barrier 26 and an upper surface 34 of the electrolyte solution 28 are parallel, separated by a vertical gap 56, and defining a discharge area 32 therebetween (see, e.g., FIG. 5).

It is well known in the art that plasma discharges can generate a significant amount of heat, due the presence of highly energetic species in the plasma. In the illustrated embodiment of FIGS. 1 to 9, this heat thus generated is diffused and transferred to the electrode 24 and the electrolyte solution 28 which, in turn, are expected to undergo a corresponding increase in temperature.

Accordingly, adapting DBD plasma technology to industrial and/or continuous-flow particle synthesis applications can involve the provision or the design of a mechanism for adequate temperature control and heat dissipation in both the electrolyte solution and the DBD plasma apparatus itself. In an embodiment where the DBD plasma apparatus is operated in a continuous-flow mode, regulating the temperature of the electrolyte solution can be facilitated by its continuous replacement in the electrolyte vessel so that any excess heat absorbed can be dissipated outside of the apparatus. This especially applies in an implementation where the electrolyte solution remains in the electrolyte vessel during a relatively brief period of time. However, heat dissipation in the electrode can be more challenging, and more targeted heat extraction mechanisms may have to be developed to enable the dissipation of heat absorbed by the electrode from the highly energetic species of the plasma. In a non-limitative embodiment, the upper electrode may be provided as a liquid-filled glass cell purposefully designed for facilitating heat extraction and dissipation, as will now be described. Of course, in other embodiment, the electrode need not be a liquid-filled electrode, but could be embodied by a metallic surface placed in physical (intimate) contact with the dielectric barrier, i.e. substantially free of gap inbetween and the physical contact inbetween should be substantially continuous, and cooled through a conventional liquid-mass heat exchanger, by heat-dissipation fins, or another suitable device or system for heat dissipation.

Referring now to FIGS. 3 and 5 to 7, in the illustrated embodiment, the electrode 24 can be provided as heat-extraction water-glass electrode system, based on a glass cell of standard dimensions (e.g., 12.5×12.5×70 $mm^3$; wall thickness: 1.25 mm, commercially available from Starna Cell™). In the illustrated embodiment, the electrode 24 includes two adjacent water-filled glass cells 58 serially arranged and electrically connected in parallel over the electrolyte flow path of the electrolyte vessel 22. In a non-limitative embodiment, the glass cells may be disposed 3 mm above the electrolyte solution surface. The contiguous bottom surfaces 60 of the two glass cells 58 together act as the dielectric barrier 26 of the plasma apparatus 20 and cover a total area of 10 $cm^2$ corresponding to the plasma-liquid treatment area. It is to be understood that these characteristics of the glass cells 58 forming the electrode 24 and the dielectric barrier 26 of the plasma apparatus 20 are provided for purposes of illustration only, and are not to be construed as limiting. In particular, the number, size, shape, location, arrangement of glass cells may be varied to suit the particularities or requirements of a given implementation.

Figure 6A:
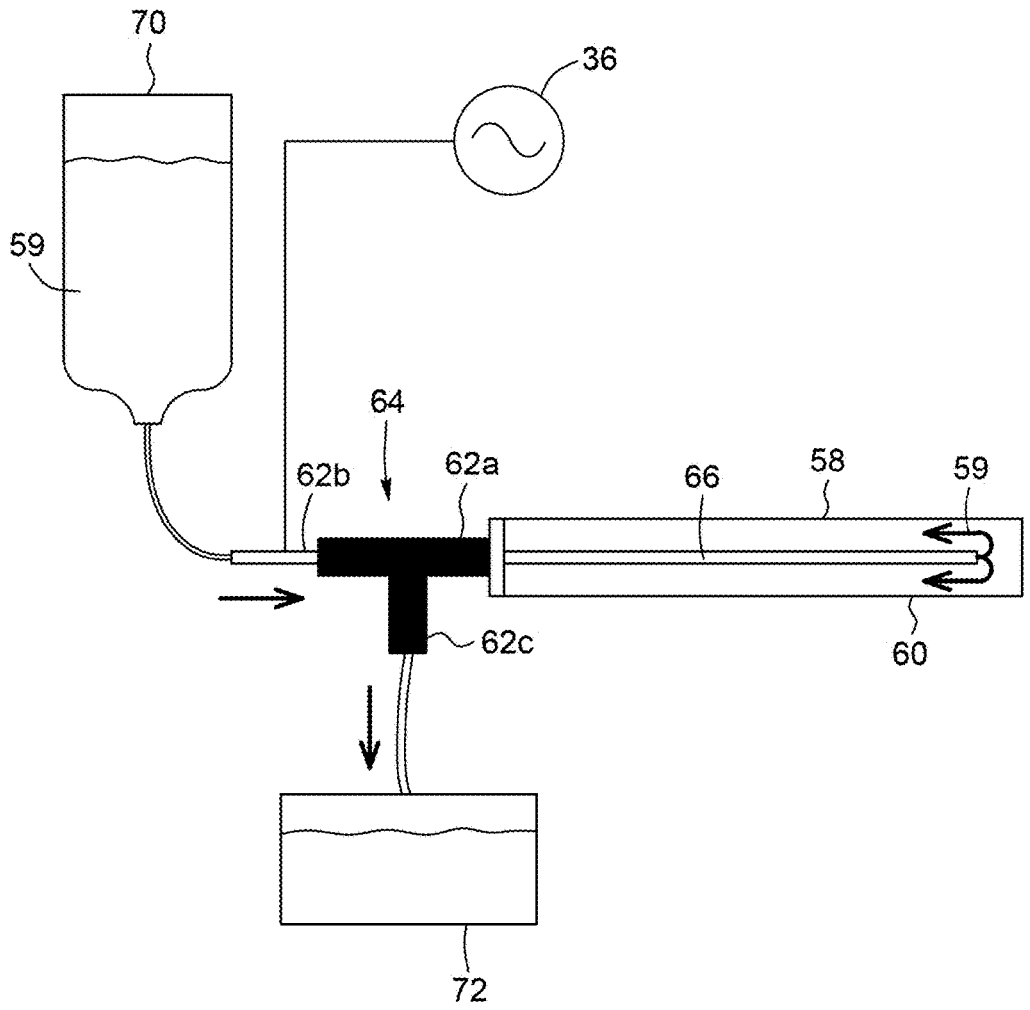
FIG. 6A is a schematic, side elevation view of a glass cell electrode of the DBD plasma apparatus of FIG. 1.

Turning more particularly to FIG. 6A, the structure and operation of non-limitative example of a glass cell 58 will be described in greater detail. The cell 58 is filled with a cooling and electrically conductive liquid 59 (e.g., tap water, water-ethylene glycol mixture, or water-oil emulsion with a low concentration of salt, or any other liquid suitable for heat dissipation) which is continuously replaced to evacuate the heat generated by the plasma process. The open end of the cell 58 is fluidly connected (e.g., through a threaded polyethylene plug supplemented with polyurethane-based sealant to provide an adequate seal) to a first end 62*a* of an insulating T-connector 64 (e.g., a polypropylene T-connector commercially available from Cole-Parmer™) through which the cooling liquid 59 can flow in and out of the cell 58. An electrically conducting element 66 can be inserted into the glass cell 58 at the first end 62*a* of the connector 64 using of an appropriate joint adapter (e.g., a PTFE reducer commercially available from Swagelok™). The electrically conducting element 66 can be embodied by an elongated tube made of titanium or of any another suitable conductor. In the illustrated embodiment, the electrically conducting element 66 is a hollow tube so as to let flow therethrough the cooling liquid 59 entering the glass cell 58 via the first end 62*a* of the T-connector 64. The electrically conducting element 66 is electrically connected to the electrical power source 36 and may extend in the cell 58 over the entire or a substantial portion of the length of the cell 58, to ensure or facilitate the application of an electric field that remains as uniform as possible over the bottom surface 60 of the cell 58. Referring still to FIG. 6A, the T-connector 64 also includes a second end 62*b* fluidly connected to a cooling liquid reservoir 70 from which the new cooling liquid 59 is supplied. The T-connector finally includes a third end 62*c* fluidly connected to a heated liquid reservoir 72 where the cooling liquid 59 exiting the cell 58 is directed for dissipating the heat accumulated therein. In the illustrated embodiment, the cooling liquid reservoir 70, the cell 58 and the heated liquid reservoir 72 are disposed relative to one another to enable the cooling liquid 59 to flow from the cooling liquid reservoir 70, in and out of the cell 58, and to the heated liquid reservoir 72 by gravity draining. In another embodiment, a suitable pump could be used to enable circulation of the cooling liquid. The flow path of the cooling liquid 59 is depicted by arrows in FIGS. 3, 6A and 7.

In an alternative embodiment, the shape of the insulating connector can vary from the embodiment shown in the Figures and described above.

Figure 6C:
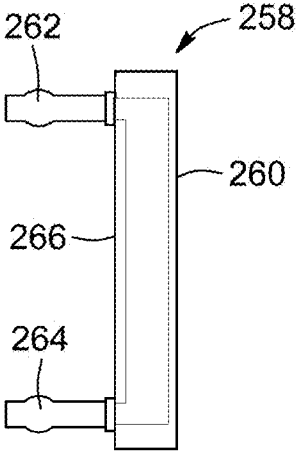
FIG. 6C is a schematic cross-sectional view of the glass cell electrode shown in FIG. 6B.
Figure 6B:
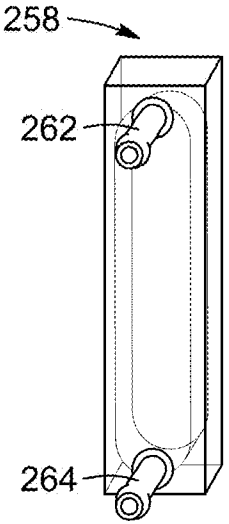
FIG. 6B is a schematic perspective view of an alternative embodiment of the glass cell electrode of the DBD plasma apparatus wherein the glass cell electrode includes a cooling liquid inlet port and a cooling liquid outlet port.

Referring to FIGS. 6B and 6C, there is shown an alternative embodiment of the glass cell 258 of the DBD plasma apparatus, wherein the features of the glass cell 258 are numbered with reference numerals in the 200 series which correspond to the reference numerals of the previous embodiment. In comparison with the glass cell 58, the glass cell 258 is provided with a cooling liquid inlet port 262 and a cooling liquid outlet port 264, spaced-apart from one another, to provide a substantially linear cooling liquid flow inbetween, as shown in FIG. 6C. Thus, the electrolyte solution can be continuously replaced to evacuate at least partially the heat generated by the plasma process. In the embodiment shown, each one of the cooling liquid inlet port 262 and the cooling liquid outlet port 264 includes a tube extension protruding from an upper surface 266 of the glass cell 258 and connectable to cooling liquid tubings. As for the embodiment described above in reference to FIG. 6A, a bottom surface 260 of the glass cell 258 acts as the dielectric barrier of the DBD plasma apparatus.

It is appreciated that the depth of the glass cell 258 can vary. For instance and without being limitative, the depth of the glass cell 258 can range between 0.01 mm and 5 mm. Accordingly, a volume of electrolyte solution that can be contained at once in a glass cell 258 can differ from one configuration to another.

Referring back to FIG. 3, the plasma apparatus 20 also includes gas inlet and outlet ports 74*a*, 74*b* in fluid communication with the discharge area 32 and through which gas 30 can enter in and exit from the discharge area 32, respectively. The gas inlet ports 74*a* may each be provided with an appropriate connector element (e.g., a PVDF connector commercially available from Cole-Parmer™) for connection with a gas supply unit 75. The gas inlet and outlet ports 74*a*, 74*b* may be embodied by openings extending through the base 40 and/or cover 42 of the apparatus 20 so to be fluidly connected to the discharge area 32. As described below, the gas inlet port 74*a* is configured for supplying gas in the discharge area 32 while the gas outlet port 74*b* is configured for evacuating the ionized gas 30 therefrom.

Turning now to FIGS. 5 and 7, the plasma-based synthesis of metal particles using the DBD plasma apparatus 20 will now be described in greater detail. The synthesis of a metal particle suspension from the electrolyte solution 28 occurs when the electrolyte solution 28 is received in the electrolyte vessel 22. In the illustrated embodiment, the electrolyte solution 28 containing metal ions, and optionally a surfactant, flows under and spaced from the glass cells 58 forming the electrode 24 and the dielectric barrier 26. In some implementations, the provision of a surfactant can help to lower the surface energy of the particles and, thus, to favor their stabilization as colloids. The bottom surfaces 60 of the glass cells 58 act as the dielectric barrier 26 of the plasma apparatus 20. The gap 56 existing between the upper surface 34 of the electrolyte solution 28 and the bottom surfaces 60 of the glass cells 58 defines the discharge area 32. The dimensions of the discharge area 32 are selected or adapted for enabling the ignition of a plasma 38 at atmospheric pressure.

The process involves continuously supplying gas 30 to the discharge area 32 through the gas inlet port 74*a*. The gas 30 can be an inert gas (or gas mixture) such as and without being limitative, argon, helium, xenon, neon and the like, or a reactive gas (or gas mixture), such as and without being limitative, $N_2$, $H_2$, $NH_3$, carbon dioxide, air, water vapor, oxygen and the like. The flow path of the gas 30 in and out of the discharge area 32 is depicted by arrows in FIGS. 3, 5 and 7. In FIG. 5, as gas 30 is continuously supplied to and evacuated from the discharge area 32 through the gas inlet and outlet ports 74*a*, 74*b*, the process also involves applying an alternating or pulsed direct electrical potential difference between the electrode 24 and the electrolyte solution 28, using the electrical power source 36 (shown in FIG. 7). As mentioned above, in the techniques described herein, the electrolyte solution 28 acts as a counter-electrode polarized against the electrode 24. In a non-limitative embodiment, the electrical power source 36 is an alternating power source generating any of low-frequency (LF) discharges, radio-frequency (RF) discharges, microwave (MW) discharges or high-voltage nanopulse discharges. A pulsed high-voltage source could also be used. In these or other non-limitative embodiments, several power sources can be combined. The amplitude of electrical potential difference is sufficient to generate a plasma 38 in the discharge area 32 and onto the plasma-electrolyte interface 34 so as to interact with the metal ions and, as a result, synthesize the metal particles. In an embodiment, the plasma 38 is generated at atmospheric pressure in an ambient air environment. However, those skilled in the art will appreciate that the plasma 38 can be generated at atmospheric pressure in an inert, reactive or other gas environment.

The plasma 38 may contain a high-density of energetic electrons, as well as a strong presence of ionic species. The ionization process at play in a DBD plasma process is generally the Townsend avalanche, which generates random electric arcs between the electrode 24 and the electrolyte solution 28. As known in the art, the potential $V_b$ required to maintain the plasma 38 depend on the gas pressure p and on the distance d between electrodes. The distance d is governed by the Paschen law:

$$V_b = \frac{apd}{\ln(pd) + b},$$

where a and b are constants that depend on the gas 30 used to generate the plasma 38. For example, in a non-limitative embodiment using argon at atmospheric pressure, and for a voltage of 3 kV, the distance d between the two electrodes is expected to be less than 1 cm.

Figure 11:
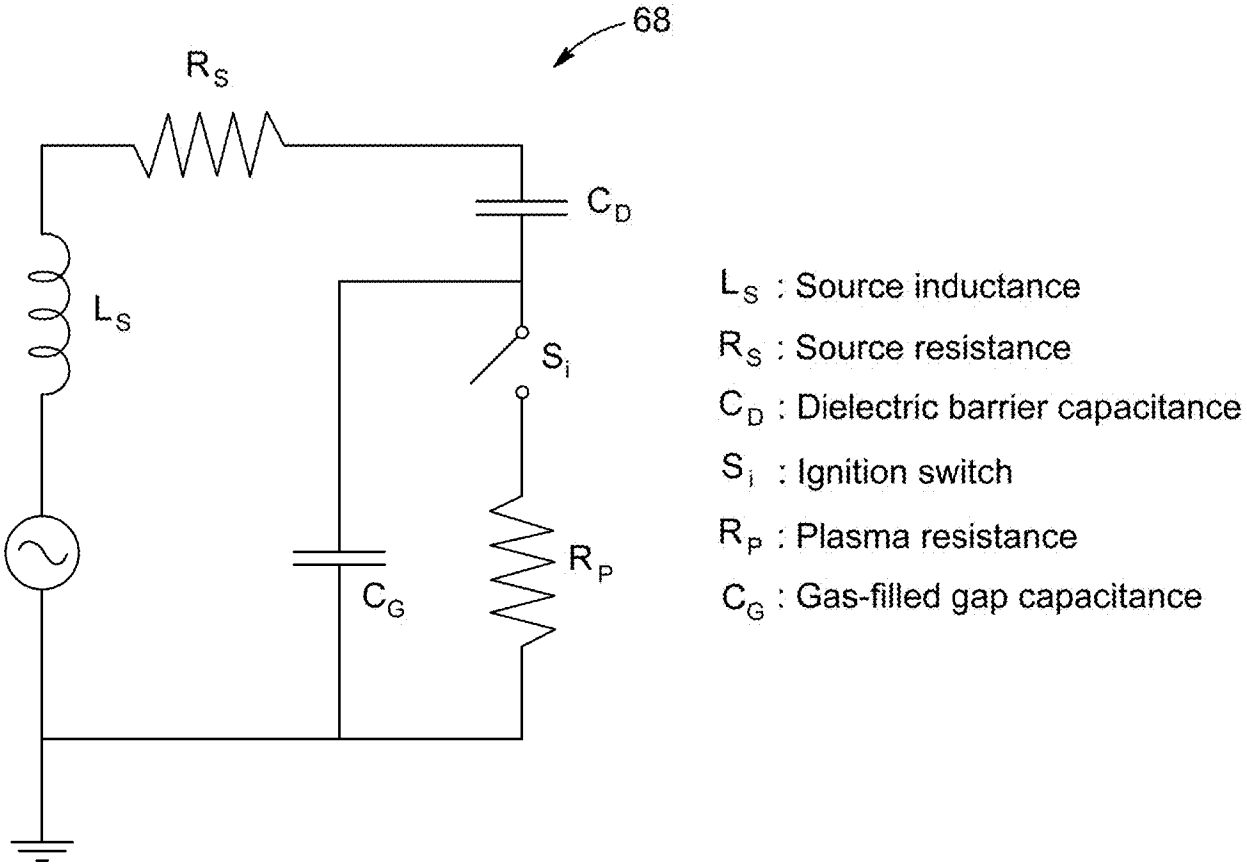
FIG. 11 is a schematic representation of the equivalent electrical circuit of a DBD plasma apparatus, in accordance with an embodiment.

Referring now to FIG. 11, the equivalent electrical circuit 68 of a DBD plasma reactor is shown. The ignition switch is closed when electrical breakdown is reached and the plasma is created between the electrodes. The capacitances $C_D$ of the dielectric barrier and $C_G$ of the gas supplied in the discharge area may be expressed as:

$$C_D = 0.089\frac{k_D A}{t_D},\ C_G = 0.089\frac{k_G A}{t_G},$$

where $C_D$ and $C_G$ are given in picofarads (pF), $k_D$ and $k_G$ are the dielectric constants of the dielectric barrier and gas, A is the electrode area in $cm^2$, $t_D$ is the thickness of the dielectric barrier in cm, and $t_G$ is the gap height in cm. Those skilled in the art will appreciate that by varying any of these three parameters for either or both of the dielectric barrier and gas it may be possible to optimize the electrical current in the plasma discharges, thus increasing the efficiency of the synthesis process. The operating frequency of the electrical power source may also have a direct effect on the process efficiency. For example, in the kHz range, a higher frequency will typically lead to a higher current. Therefore, at a given electrical potential, operating the DBD plasma reactor at 25 kHz rather than 3 kHz, for example, may lead to an electrical current which is increased by a factor of six.

Referring now to FIGS. 1 to 3 and 7, the DBD plasma apparatus 20 may also allow for real-time temperature and pH monitoring, and optionally adjustment, of the electrolyte solution 28 at the entry and exit of the synthesis region 48. In an embodiment, the plasma apparatus 20 can include a pair of openings 76*a*, 76*b* extending through the cover 42 and partially into the base 40. The pair of openings 76*a*, 76*b* may be aligned with the input and output ends 78*a*, 78*b* of the electrolyte flow path. In the illustrated embodiment, the openings 76*a*, 76*b* also act as the gas outlet ports 74*b*. For this purpose, the trench defining the electrolyte flow path may be slightly deeper at the input and output ends 78*a*, 78*b* thereof to facilitate the introduction and use of pH probes (not shown) and temperature probes 79. In an embodiment, the temperature probes 79 are thermocouples provided with a metal cladding that can be used to electrically ground the electrolyte solution 28 to earth. In another embodiment, a conductor other than thermocouples can be used to ground the electrolyte solution, for example conducting rods optionally coated with conducting cladding to prevent degradation of the electrolyte solution. As known in the art, the pH of the electrolyte solution should, in some scenarios, be maintained in a range determined in accordance with the Pourbaix diagram of the elemental ion/solid phase system being used in a given experiment. In a non-limitative embodiment, the pH of the solution should be maintained between about 2 and about 7. In some embodiments, the temperature and pH monitoring systems could be used in conjunction with a retroactive system. The retroactive system could allow for pH adjustment through NaOH or KOH basic solution additions and/or temperature adjustments through a conventional water cooling/heating system provided externally of the DBD plasma apparatus, (e.g., inserted on tubing line 53; see FIG. 2).

Figure 8:
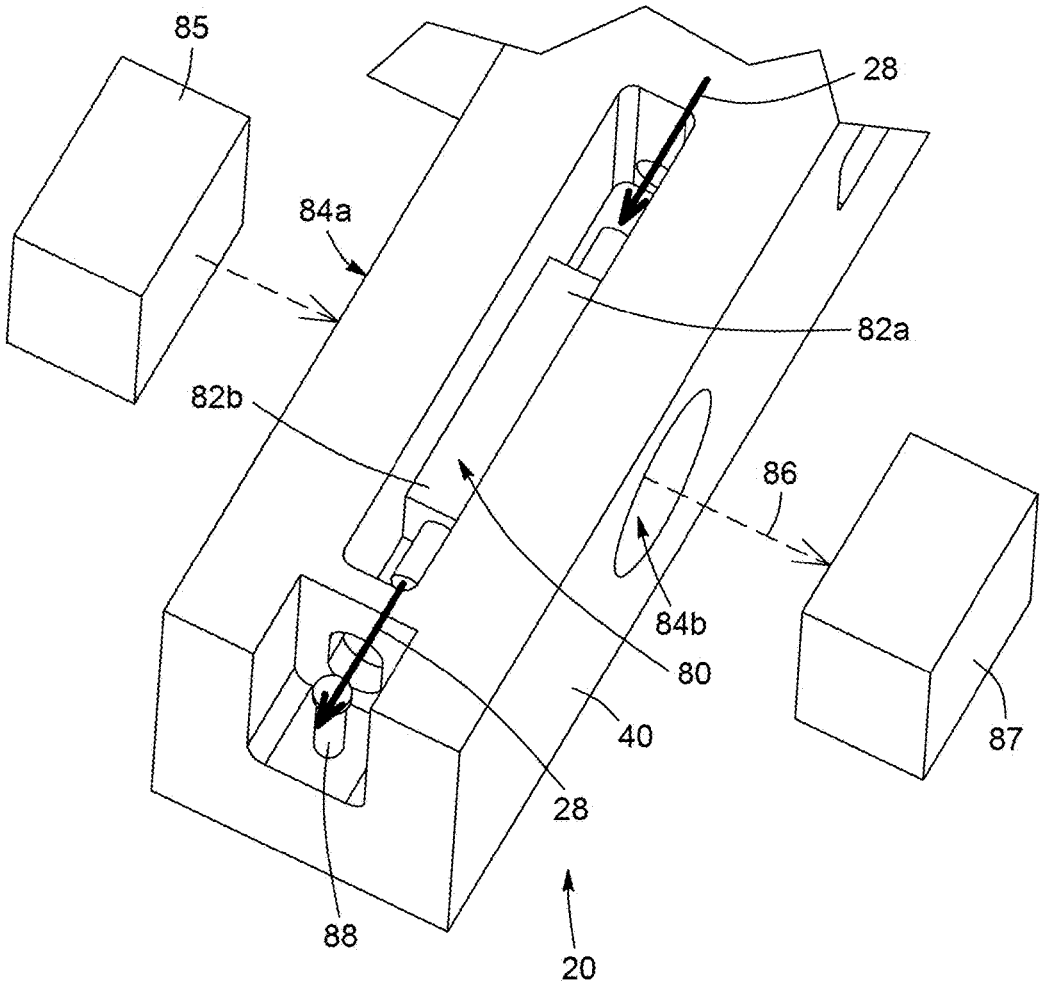
FIG. 8 is another schematic, partial perspective view of the DBD plasma apparatus of FIG. 1, in which the cover has been removed to better illustrate the spectroscopy cell. The flow path of the electrolyte solution in the spectroscopy cell is depicted by arrows.

Referring to FIG. 8, the DBD plasma apparatus 20 may further include a spectroscopy cell 80 disposed downstream of the electrolyte vessel 22. For example, in a non-limitative embodiment, the spectroscopy cell 80 is an ultraviolet-visible (UV-vis) spectroscopy linear flow cell, commercially available from Starna Cells™. The spectroscopy cell 80 may include a cell inlet port 82*a* fluidly connected to the electrolyte outlet port 46*b* and receiving therefrom the electrolyte solution 28 (or a portion thereof) exiting from the electrolyte vessel 22. The spectroscopy cell 80 may also include a cell outlet port 82*b* for discharging the electrolyte solution 28 following its passage inside the spectroscopy cell 80. It will be understood that, in some implementations, because the electrolyte solution 28 enters the spectroscopy cell 80 directly after flowing out of the electrolyte vessel 22, the spectroscopy cell 80 can allow the nucleation and growth of the metal particles to be monitored in situ and in a real-time. The flow path of the electrolyte solution 28 through the spectroscopy cell 80 is depicted by arrows in FIG. 8.

Figure 9A:
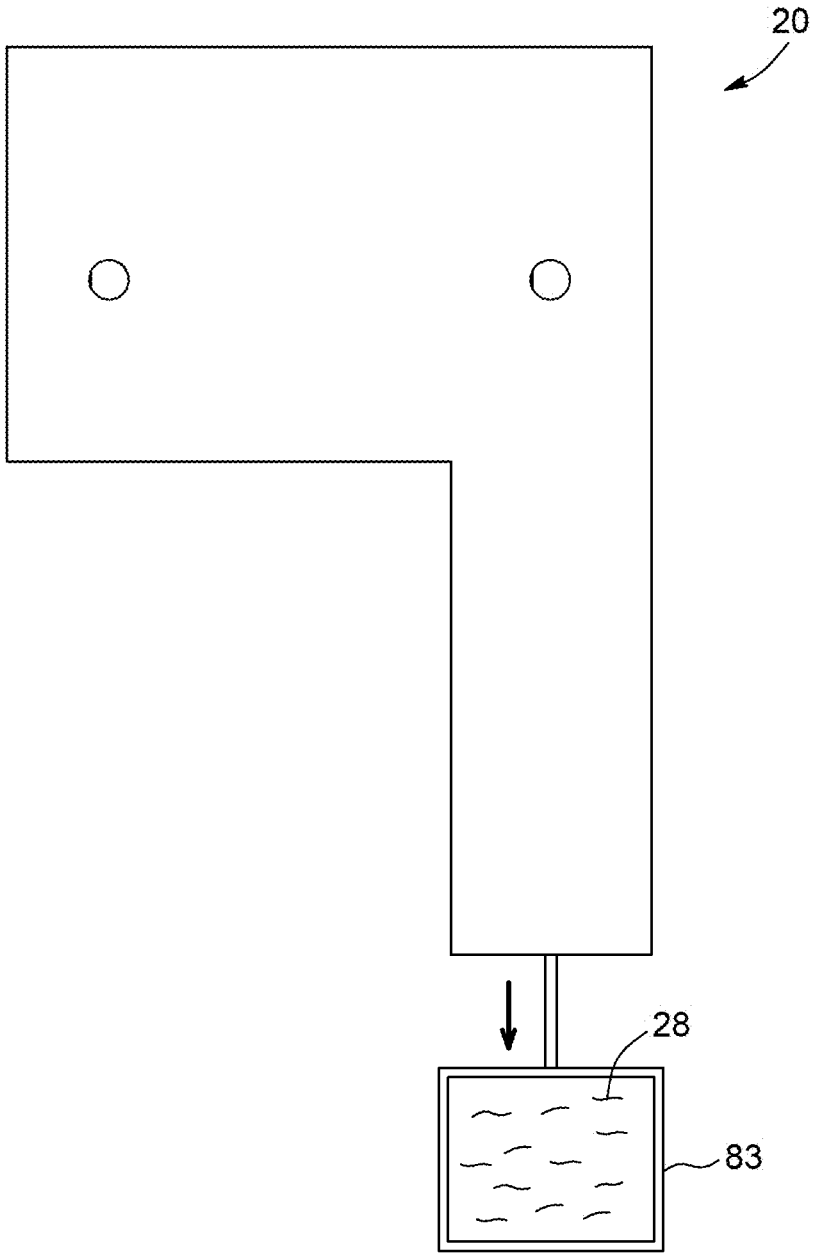
FIG. 9A is a top plan view of the DBD plasma apparatus of FIG. 1, operated in a single-pass, continuous flow mode.
Figure 9B:
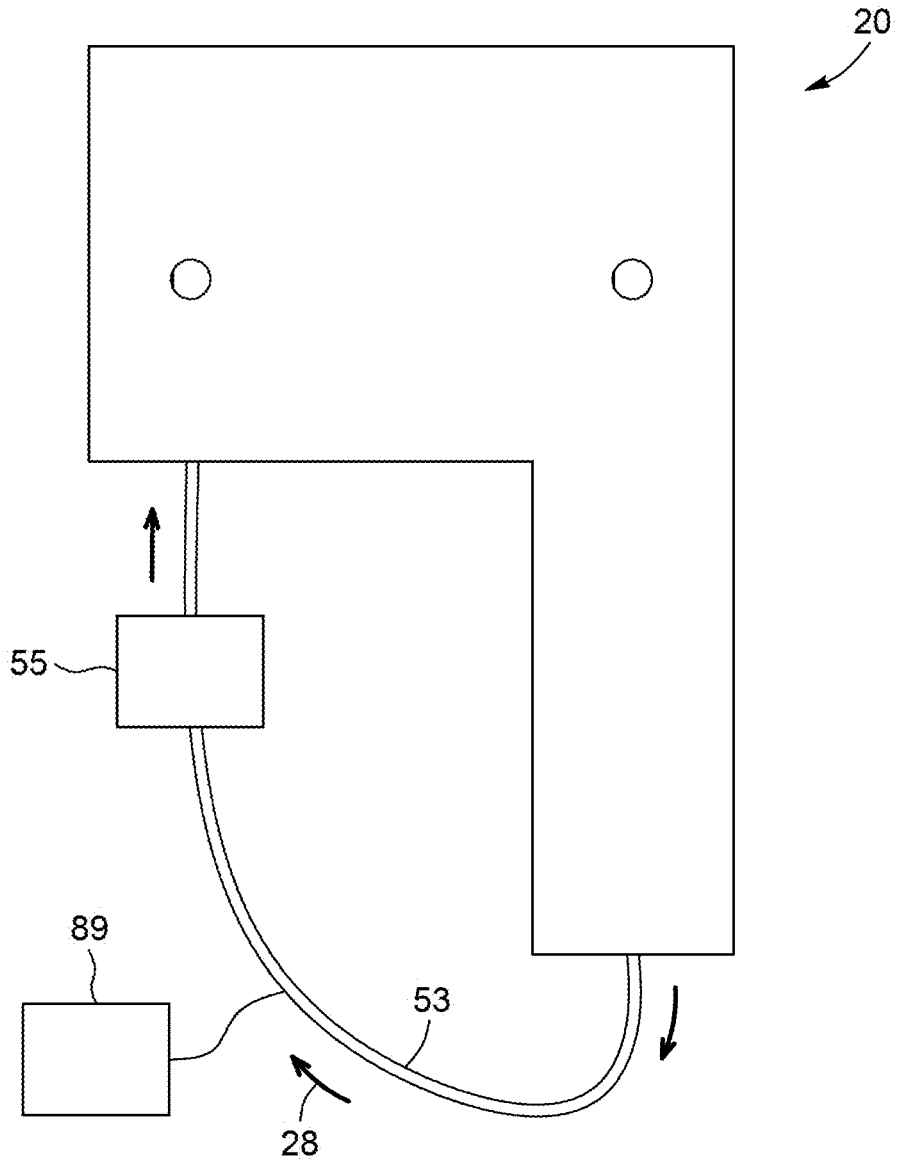
FIG. 9B is a top plan view of the DBD plasma apparatus of FIG. 1, operated in a multiple-pass, continuous flow mode.
Figure 10:
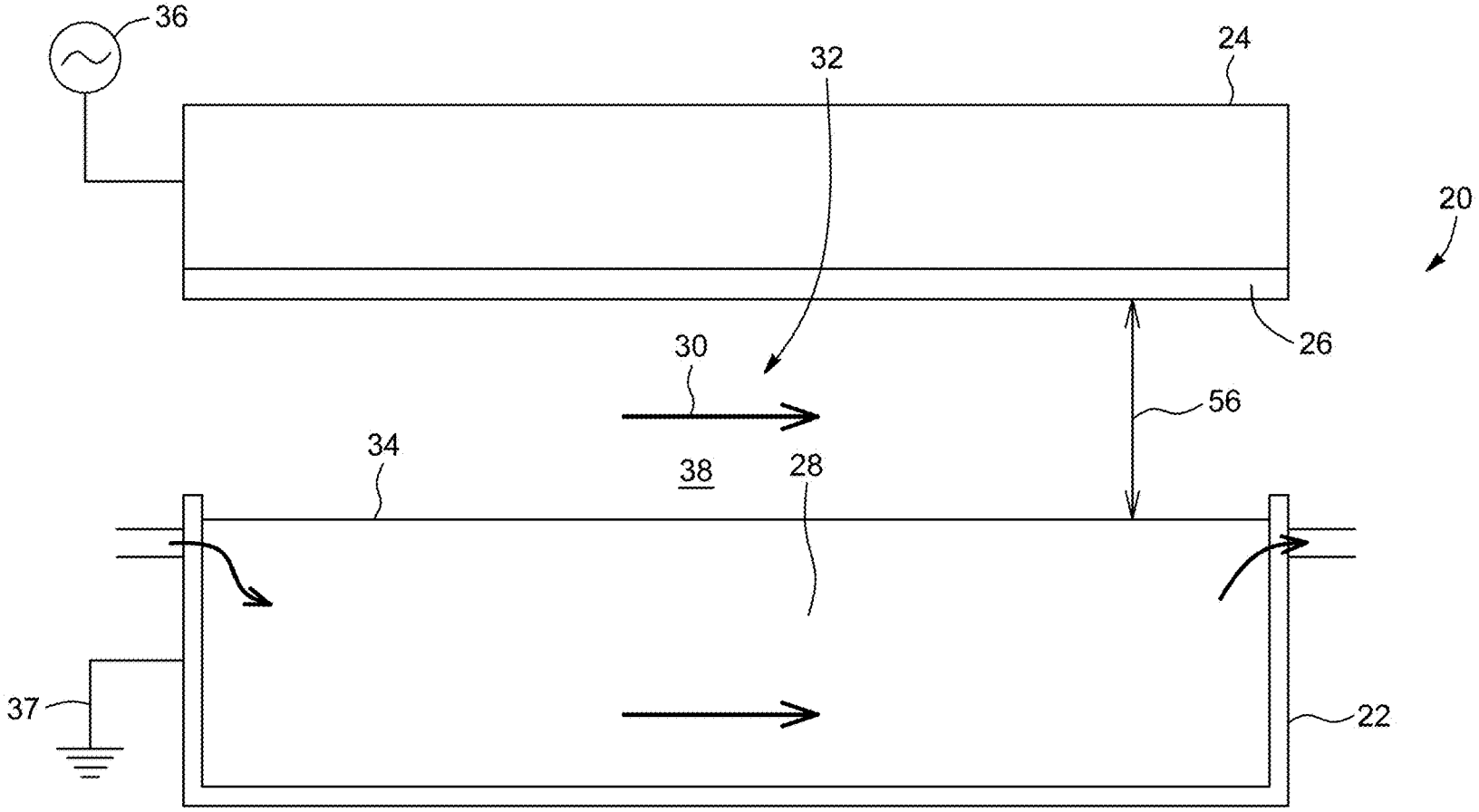
FIG. 10 is a schematic representation of the DBD plasma-based particle synthesis process, in accordance with an embodiment.

In an embodiment where the metal particle synthesis process is carried out in a single-pass or open-circuit mode, the electrolyte solution 28 may be discharged to an external collector 83 or be otherwise evacuated from the plasma apparatus 20 (see FIG. 9A). Alternatively, in an embodiment where the synthesis process is carried out in a multiple-pass or closed-circuit mode, the electrolyte solution 28 exiting from the cell outlet port may be received in a tubing line 53 and be conveyed or pumped back (e.g., using a peristaltic pump 89) toward the electrolyte inlet port of the electrolyte vessel to start another cycle of the DBD plasma synthesis process (see FIG. 9B).

Referring back to FIG. 8, in a non-limitative embodiment, the base 40 of the plasma apparatus 20 includes first and second UV-visible light transmitting windows 84*a*, 84*b* facing each other on opposite sides of the spectroscopy cell 80. A UV-visible light source 85 may be provided for projecting UV-visible radiation through the first transmitting window 84*a* and onto the spectroscopy cell 80. The UV-visible radiation reaching the spectroscopy cell 80 is partly absorbed by the electrolyte solution 28 flowing therein, transmitted through the second transmitting window 84*b*, and detected by a spectrometer 87. The dashed line in FIG. 8 depicts the optical path 86 of the UV-visible radiation incident on and partly absorbed by the electrolyte solution 28 in the spectroscopy cell 80. The absorption spectrum of the electrolyte solution 28 may be determined from the data measured by the spectrometer. In turn, the spectral characteristics (e.g., the profile, width, height, peak position, and the like) of the absorption spectrum of the electrolyte solution 28 may provide real-time information indicative of the presence, chemical composition, density and/or size of the metal particles throughout the synthesis process. It is to be noted that the cover of the plasma apparatus 20 may act as shield that blocks light incident from the top of the spectroscopy cell 80, thereby reducing background noise that could otherwise affect the measured spectra.

Referring to FIG. 1, in a non-limitative embodiment, the DBD plasma apparatus 20 can include a gap controller 88 for adjusting the gap (i.e., the vertical distance d symbolized by reference character 56 in FIG. 5) between the upper surface 34 of the electrolyte solution 28 and the dielectric barrier 26, the latter corresponding to the bottom surfaces 60 of the liquid-filled glass cells 58 in the illustrated embodiment. It will be recognized that, by providing control over the value of the gap, the gap controller 88 may therefore control the ignition and sustainability of the plasma during the particle synthesis process, which can be relatively important in some implementations. For example, in an embodiment operated in a batch mode, fluctuating electrolyte solution levels due to gas agitation or evaporation may cause the plasma discharge to be disrupted or otherwise perturbed, which is generally better avoided. The gap controller 88 may also be used to ensure the electrolyte solution level inside the spectroscopy cell 80 is sufficient so as not to falsify or distort the measured absorption spectra.

In the illustrated embodiment, the gap controller 88 controls the gap by adjusting the level of the electrolyte solution 28 in the electrolyte vessel 22 and is embodied by a manually-operated leveling screw provided at the downstream end of the DBD plasma apparatus 20, as depicted in FIG. 1. In another non-limitative embodiment, the gap controller 88 may alternatively or additionally control the gap by physically controlling the relative vertical distance between the electrolyte vessel 22 and the electrode 24. Those skilled in the art will appreciate that the actual mechanical movement by which the gap is controlled may be accomplished or triggered by any appropriate automated or manually-operated controller using mechanical, electrical, optical and/or other actuating means. In some implementations, the gap controller 88 maintains the vertical gap between about 1 to about 10 mm.

In some implementations, it may be desirable that the DBD plasma apparatus be fabricated with materials that can support harsh, acidic or otherwise potentially damaging conditions or environments. It may also be desirable that the DBD plasma apparatus be provided with a modular structure based on simple-shaped, easy-to-replace and readily available components. Indeed, in a non-limitative embodiment, the presence of metal ions and surfactants in harsh acidic conditions, coupled with the need for occasional decontamination with highly corrosive metal dissolving agents (e.g., aqua regia) makes it desirable to design an apparatus that allows its main components to be easily, efficiently and inexpensively replaced. To this end, and as mentioned above, the base, cover, and electrolyte vessel may be made of HDPE or PTFE, or another material that can sustain strongly corrosive or acidic environments. Other components of the plasma apparatus may include standard, commercially available components such as glass cells (e.g., the heat-extraction water-filled electrode) and silicone tubing (e.g., to convey the electrolyte flow in and out of the electrolyte vessel).

Figure 12A:
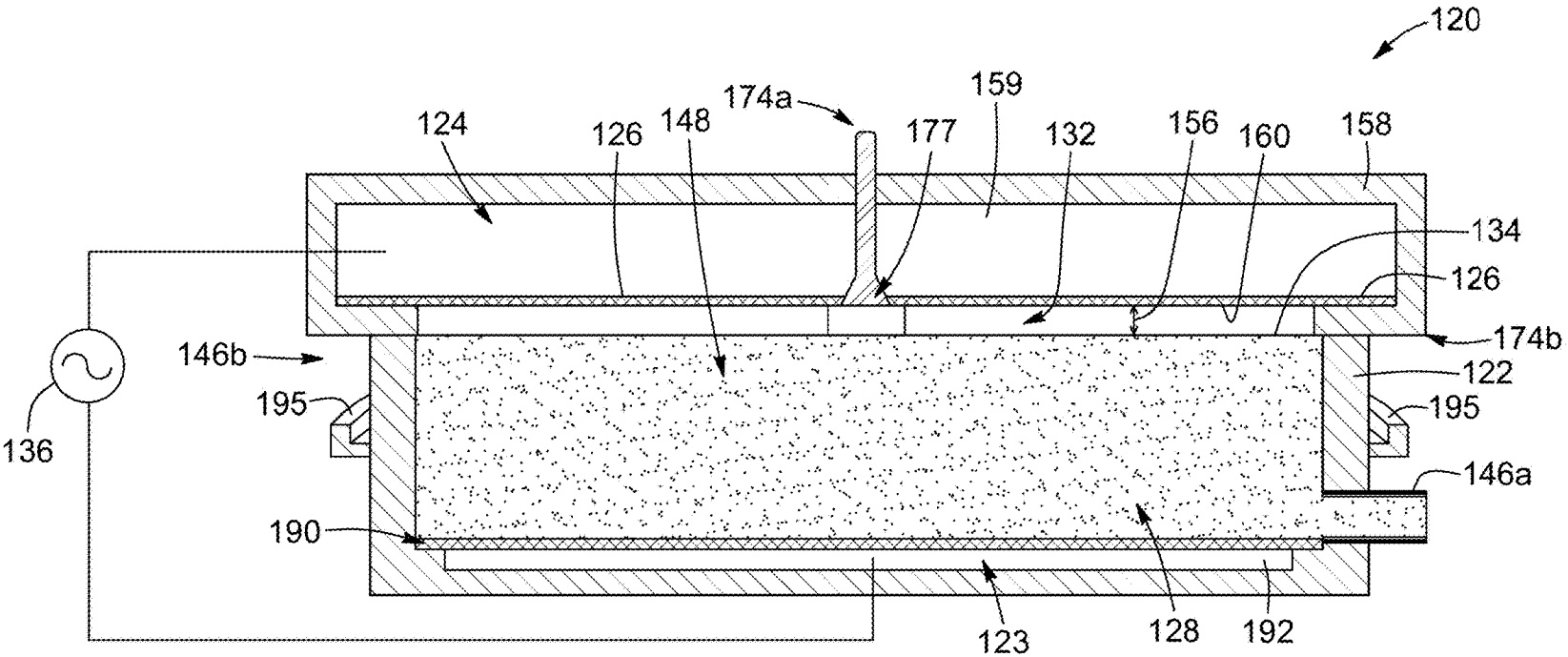
FIG. 12A is a schematic cross-sectional view of a DBD plasma apparatus in accordance with an alternative embodiment, wherein an overflow of the electrolyte solution is evacuated from the electrolyte vessel.
Figure 12B:
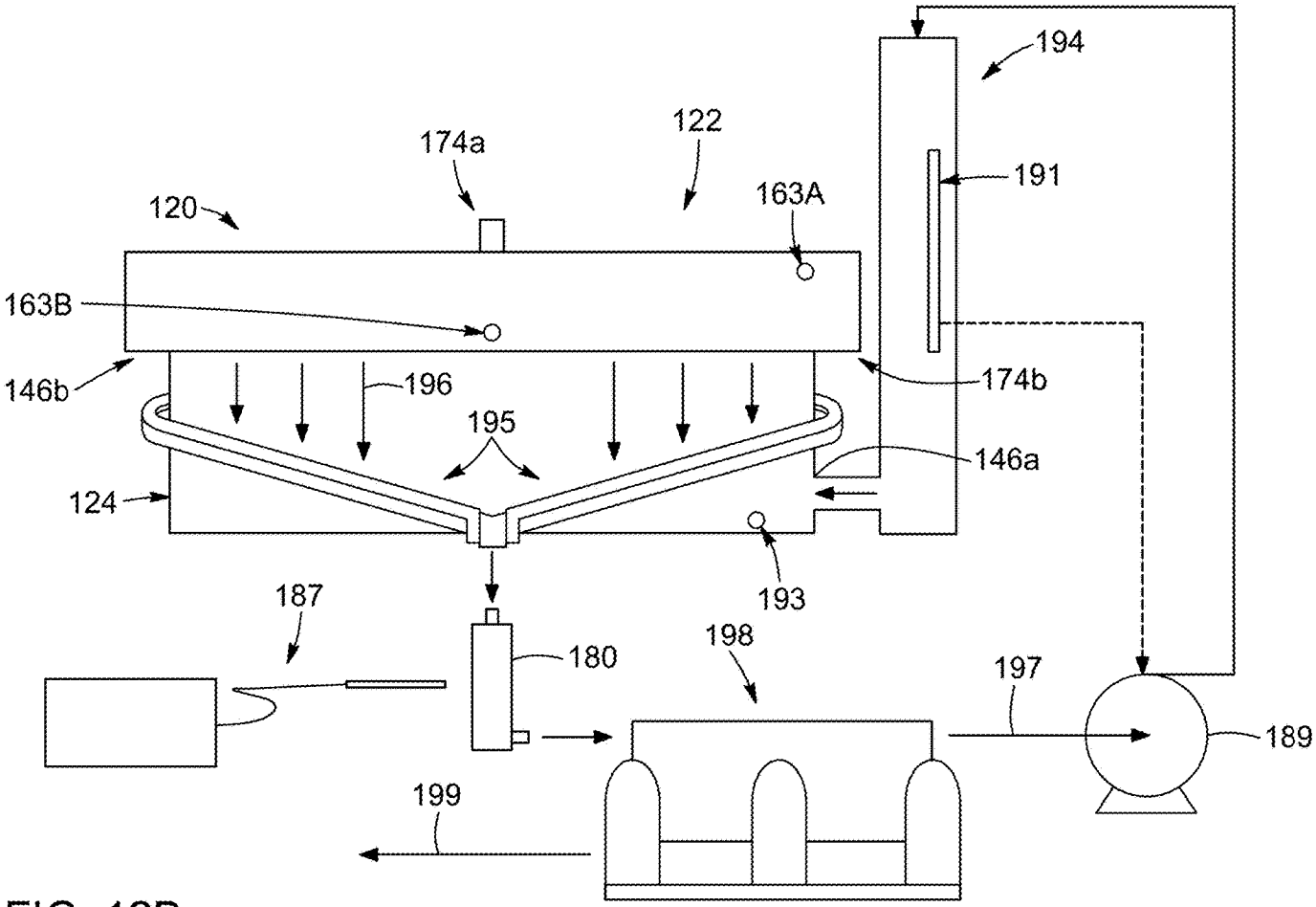
FIG. 12B is a schematic representation of a particle synthesis system including the DBD plasma apparatus of FIG. 12A.

Referring now to FIGS. 12A and 12B, there is shown an alternative embodiment of the DBD plasma apparatus wherein the features are numbered with reference numerals in the 100 series which correspond to the reference numerals of the previous embodiment. The DBD plasma apparatus 120 includes at least an electrolyte vessel 122, an upper liquid electrode 124, spaced-apart from the electrolyte vessel 122, and a dielectric barrier 126 interposed between the electrolyte vessel 122 and the electrode 124. A discharge area 132 extends between an upper surface 134 of the electrolyte solution 128 and the dielectric barrier 126 and defining a gap 156. The electrolyte vessel 122 further includes a lower liquid electrode 123, extending below a synthesis region 148 of the electrolyte vessel 122 configured to contain the electrolyte solution 128, as will be described in more details below.

The upper liquid electrode 124 is contained in a liquid-containable cell 158 including the dielectric barrier 126 as bottom surface 160. In a non-limitative embodiment, the dielectric barrier 126 can be made of glass. The liquid-containable cell 158 is mounted above the electrolyte vessel 122 and extends over the entire synthesis region 148 of the electrolyte vessel 122. In the embodiment shown, a surface area of the synthesis region 148 of the electrolyte vessel 122 is substantially equal to a surface area of the dielectric barrier 126.

A cooling and electrically conductive liquid 159 can at least partially fill the liquid-containable cell 158. As shown in FIG. 12B, in the embodiment shown, the liquid-containable cell 158 includes a cell inlet port 163A and a cell outlet port 163B in fluid communication a chamber defined in the liquid-containable cell 158 to create a flow path of the electrically conductive liquid 159 therein. The cooling and electrically conductive liquid 159 evacuates heat generated by the plasma process by being continuously replaced with cooler electrically conductive liquid 159. In an embodiment, the cell inlet port 163A is in fluid communication with a cooling and electrically conductive liquid supply (not shown). The electrically conductive liquid 159 can circulate through the liquid-containable cell 158 by gravity or a suitable pump could be used to enable circulation of the electrically conductive liquid 159.

The DBD plasma apparatus 120 also includes a gas inlet 174*a* in fluid communication with the discharge area 132 and through which gas fills the discharge area 132. In the embodiment shown, the gas inlet port 174*a* extends through the liquid-containable cell 158 and ends with a gas diffuser 177, substantially aligned with the dielectric barrier 126. The gas inlet port 174*a* may be connectable to a gas supply unit (not shown).

The lower liquid electrode 123 extends below the synthesis region 148 of the electrolyte vessel 122 and is separated therefrom by a dielectric barrier 190. In the embodiment shown, the dielectric barrier 190 is a glass barrier. The properties of the dielectric barrier are substantially similar to the dielectric barriers 26, 126. The walls of the electrolyte vessel 122 in combination with the glass barrier 190 define an lower liquid electrode cell with a lower liquid electrode chamber fillable with an electrically conductive liquid 192. In the embodiment shown, a surface area of the lower liquid electrode 123 is substantially equal to a surface area of the synthesis region 148 of the electrolyte vessel 122. As shown in FIG. 12B, the electrolyte vessel 122 includes an electrode chamber inlet port 193 and an electrode chamber outlet port (not shown). The electrode chamber inlet port 193 and the electrode chamber outlet port are in fluid communication with the liquid electrode chamber to create a flow path of the electrically conductive liquid therein. As the cooling and electrically conductive liquid 159, the cooling and electrically conductive liquid of the lower liquid electrode 123 evacuates heat generated by the plasma process by being continuously replaced with cooler electrically conductive liquid. In an embodiment, the electrode chamber inlet port 193 is in fluid communication with a cooling and electrically conductive liquid supply (not shown). As the cooling and electrically conductive liquid 159, the electrically conductive liquid can circulate through the liquid electrode chamber by gravity or a suitable pump could be used to enable circulation of the electrically conductive liquid.

The lower and the upper liquid electrodes 123, 124 are electrically connected to an alternative electrical power source 136. In some implementations, the power source 136 operates with a frequency ranging between 1 and 100 kHz. In one non-limitative embodiment, the power source 136 operates with a frequency of 25 kHz The electrolyte vessel 122 also includes an electrolyte inlet port 146*a* and an electrolyte outlet port 146*b* through which the electrolyte solution 128 can enter in and exits from the electrolyte vessel 122, respectively, and defining an electrolyte flow path inbetween. In the embodiment shown, the electrolyte inlet port 146*a* is provided in a lower section of the electrolyte vessel 122, adjacent to the glass barrier 190. The electrolyte outlet port 146*b* is defined by an upper edge of the electrolyte vessel 122, as will be described in more details below.

The gas outlet port 174*b* is also defined by the upper edge of the electrolyte vessel 122 and is configured for evacuating the ionized gas 30 from the electrolyte vessel 122.

In the embodiment shown, the electrolyte inlet port 146*a* is in liquid communication with the electrolyte supply 194, embodied by a flow control tower, containing a supply of the electrolyte solution 128. The electrolyte solution 128 is thus funneled to the bottom of the electrolyte vessel 122.

The DBD plasma apparatus 120 also includes an electrolyte recovery gutter 195 at least partially circumscribing the electrolyte vessel 122 to recover an overflow 196 of the electrolyte solution 128 flowing outwardly of the electrolyte vessel 122 through the electrolyte outlet port 146*b*. Since the metal particles are produced at the plasma-electrolyte interface, the embodiment shown in FIGS. 12A and 12B allows for the rapid evacuation of the produced particles into the recovery gutter and the refreshing of the electrolyte solution at the plasma-electrolyte interface.

Because the electrolyte solution 128 flows inside the synthesis region 148, the plasma-based particle synthesis process is said to be carried out as a continuous-flow process, which can either be operated in single-pass mode, where the electrolyte solution 128 flows only once between the electrolyte inlet and outlet ports 146*a*, 146*b*, or in a multiple-pass or recycle mode, where the electrolyte solution 128 flows more than once between the electrolyte inlet and outlet ports 146*a*, 146*b*.

In the embodiment shown, the plasma-based particle synthesis process is operated in a recycled mode. More particularly, the overflow 196 flows from the electrolyte recovery gutter 195 into a spectroscopy cell 180 for in situ monitoring of the concentration of the plasma-generated PGM particles by a spectrometer 187.

Then, the overflow 196 exiting the spectroscopy cell 180 flows into a concentration unit 198 wherein the constituents are separated (e.g. by rapid centrifugation, by continuous-flow filtration, and the like). The supernatant 197 is recuperated (in a multiple-pass or recycle mode (not shown)) or discarded (in a single-pass mode). The solid precipitate 199 is recovered.

In an embodiment, the electrolyte supply 194 can contain an electrolyte level sensor 191 operatively connected to a controller (not shown). In turn, the controller sends command signal to a pump 189 in order to maintain a quantity of the electrolyte solution 128 in the electrolyte supply 194.

In some implementations wherein the DBD plasma apparatus is operated in single-pass mode or in multiple-pass mode, the DBD plasma apparatus is envisioned to process up to 1 ton per hour of electrolyte solution. In some implementations, the DBD plasma apparatus is envisioned to operate with a flow of electrolyte solution comprised between 15 and 100 L/h.

Experimental Demonstrations

Experimental demonstrations illustrating some of nanoparticle synthesis capabilities provided by an exemplary embodiment of the DBD plasma apparatus will now be described. As those skilled in the art will understand, the techniques described herein are not limited to these particular experimental demonstrations.

Preparation of Electrolyte Solutions and Plasma Synthesis

A number of synthesis procedures were performed to synthesize metal nanoparticles based on plasma-liquid electrochemistry techniques, as briefly summarized below:

- Synthesis 1 (S1): synthesis of gold nanoparticles (1 mM Au, 1 mM dextran);
- Synthesis 2 (S2): synthesis using palladium salts to illustrate nanoparticle synthesis of an element other than gold;
- Synthesis 3 (S3): synthesis of gold nanoparticles, with in-situ UV-vis monitoring for 9 minutes;
- Syntheses 4-6 (S4-S6): syntheses of gold nanoparticles using different concentrations of dextran;
- Syntheses 7-8 (S7-S8): syntheses of gold nanoparticles, using different electrical parameters (i.e., frequencies and currents);
- Syntheses 9-11 (S9-S11): syntheses of gold nanoparticles using higher electrical frequencies and currents, and different concentrations of dextran;
- Syntheses 12-15 (S12-S15): syntheses of gold nanoparticles using different concentrations of dextran; and
- Synthesis 16 (S16): synthesis of radioactive gold nanoparticles.

Synthesis 1 (S1):

1 mM $HAuCl_4.3H_2O$ (Sigma-Aldrich, >99.9%) supplemented with 1 mM dextran (Carbomer Inc., 5000 MW, clinical purity, USA), were dissolved in 20 mL of nanopure water (Barnstead D4751, 18.2 MQ-cm, USA). As known in the art, dextran is a biocompatible polysaccharide widely used to stabilize nanoparticles used in biomedical applications (e.g., intravenously injected imaging contrast agents). The precursor was quickly agitated by a vortex mixer and left in an ultrasound bath for 10 minutes (to facilitate dissolution of solutes) prior to plasma synthesis. This liquid is referred to as the electrolyte solution introduced above. Referring to FIGS. 3 and 7, the electrolyte solution 28 was introduced in the DBD plasma apparatus 20 via the electrolyte inlet port 46*a*, and kept under constant recirculation by a peristaltic pump. Then, an argon flow (Ar gas, grade 5.0: 99.9995%, Linde Canada) was sent through the gas inlet port 74*a*. The reaction temperature was maintained between 20 and 25° C. A sinusoidal electrical potential difference was applied between the electrode 24 and the electrolyte solution 28 to generate a plasma. For this purpose, an electrical power source 36 at a frequency of 3 kHz, a peak voltage of 7 kV, and a capacitive peak current of 80 mA was used. The plasma thus generated between electrode 24 and electrolyte solution 28 was applied for 10 minutes.

Synthesis 2 (S2):

same as S1, except that: (i) the metal salt was in the form of 1 mM $PdCl_2$ (Sigma-Aldrich, 99%); (ii) the dextran concentration was changed to 0.5 mM; (iii) the reaction temperature was kept at 50° C.; and (iv) the plasma treatment lasted only 15 seconds.

Synthesis 3 (S3):

same as S1, except that the plasma treatment lasted 9 minutes with continuous UV-vis spectral monitoring. More specifically, and referring to FIG. 8, an UV-vis spectrometer 87 (HR4000CG-UV-NIR, Ocean Optics, USA) was used during the plasma synthesis process and allowed, through a spectroscopy cell 80, direct monitoring of the absorbance spectrum of the electrolyte solution undergoing gold nanoparticle synthesis.

Syntheses 4 to 11 (S4 to S11):

these syntheses were performed under the same conditions as S1, but with different dextran concentrations, plasma synthesis durations and plasma electrical parameters (frequency, voltage and current), as summarized in Table 1 below.

TABLE 1

Parameters used for syntheses S4 to S11

| Synthesis number | Dextran concentration (mM) | Duration (min) | Frequency (kHz) | Voltage (kV) | Current (mA) |
|---|---|---|---|---|---|
| S4 | 0.1 | 7 | 3 | 7 | 80 |
| S5 | 0.5 | 10 | 3 | 7 | 80 |
| S6 | 2 | 5 | 3 | 7 | 80 |
| S7 | 0.1 | 5 | 3 | 7 | 80 |
| S8 | 0.1 | 5 | 25 | 7 | 500 |
| S9 | 0.1 | 12 | 25 | 5 | 350 |
| S10 | 0.5 | 12 | 25 | 5 | 350 |
| S11 | 1 | 12 | 25 | 5 | 350 |

Separation of Nanoparticles from Unreacted Metal Ions

Dialysis:

For S1 to S8, the colloidal suspensions of nanoparticles were dialyzed to remove the excess of unreacted metal ions and dextran prior to characterization. For this purpose, the suspensions were dialyzed in 10 kDa membranes (SpectraPor #6, Rancho Dominguez, Calif.) in 1 L of nanopure water for a period of 48 hours. The water was renewed after 1, 2, 4, 8, 24 and 32 hours to ensure a low concentration of metal ions and dextran molecules in the water.

Centrifugation:

For S9 to S11, the colloidal suspensions were allowed to rest at 4° C. for 24 hours after the synthesis to ensure that the synthesized nanoparticles has been fully stabilized by the dextran. The colloidal suspensions were then centrifuged (3000 g, 30 min), and the supernatant was physically separated from the sedimented nanoparticles.

Characterization of Nanoparticles

Transmission Electron Microscopy (TEM):

Drops (5 μL) of the suspension were dried on carbon-coated copper grids (Canemco-Marivac, Lakefield, Canada), and imaged by TEM (JEM-2100F).

Ex Situ UV-Vis Spectroscopy:

"off-line" UV-vis spectral absorbance measurements were performed on the electrolyte solutions before and after synthesis, using a Shimadzu UV-1601 UV-Vis spectrometer.

Atomic absorption spectroscopy (AAS):

For each of S9 to S11, the supernatant obtained after centrifugation of the solution was digested in aqua regia [HCl 70%; (Fisherbrand) and $HNO_3$ (trace metal, Fisher Scientific) in a 3:1 ratio] and $H_2O_2$ (30%, Sigma-Aldrich 95321) until the suspension turned clear and colorless. The gold concentration of these digested solutions was measured by atomic absorption spectroscopy (Perkin Elmer Analyst 800).

Results

Figure 13C:
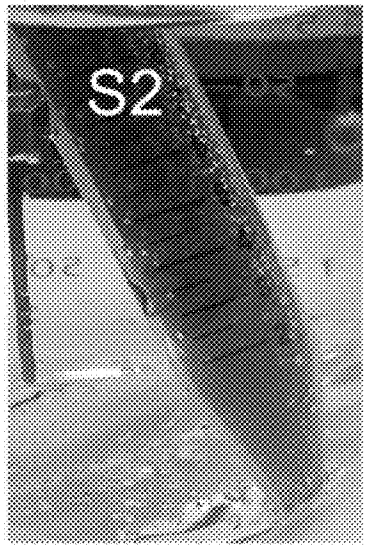
FIGS. 13A to 13C show a change in color of the electrolyte solution as a result of the nanoparticle synthesis process, in accordance with different implementations (syntheses S1 to S11 described below) of the method described herein.
Figure 13B:
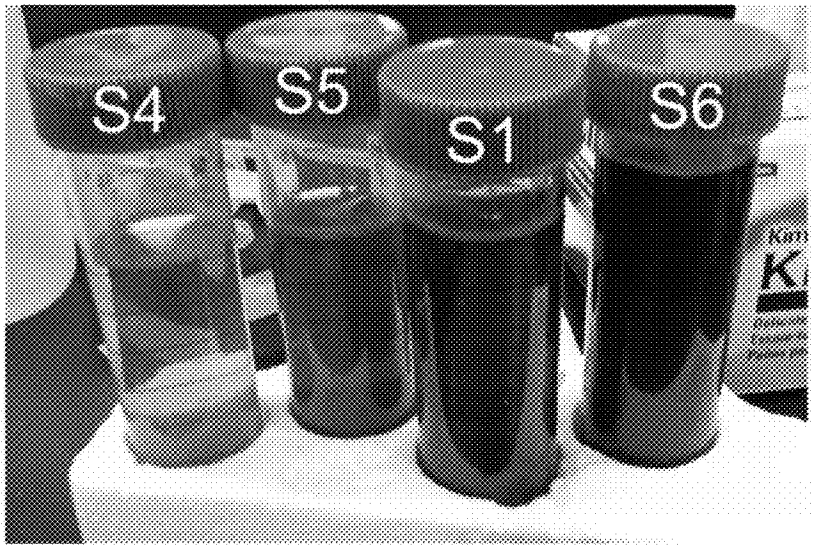
Figure 13A:
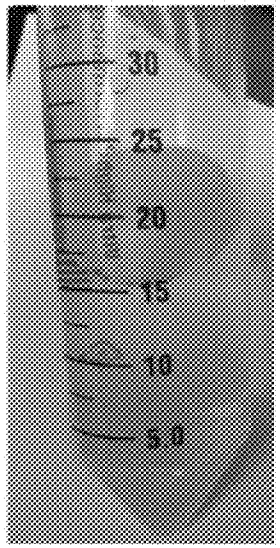
Figure 14B:
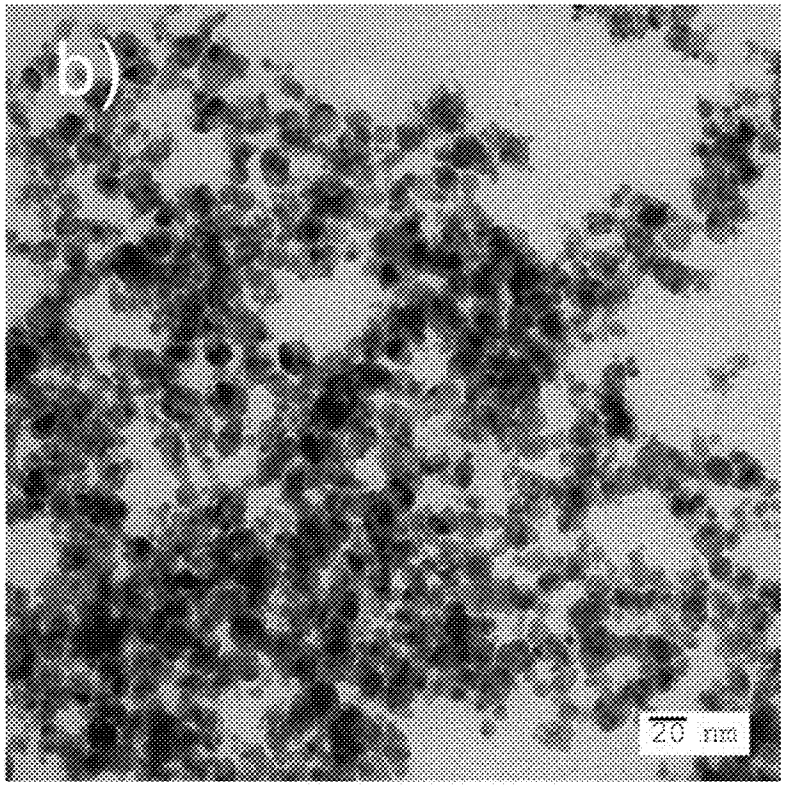
FIGS. 14A and 14B are transmission electron microscopy (TEM) images of gold (FIG. 14A) and palladium (FIG. 14B) nanoparticles synthesized according to two implementations (syntheses S1 and S2) of the method described herein.
Figure 14A:
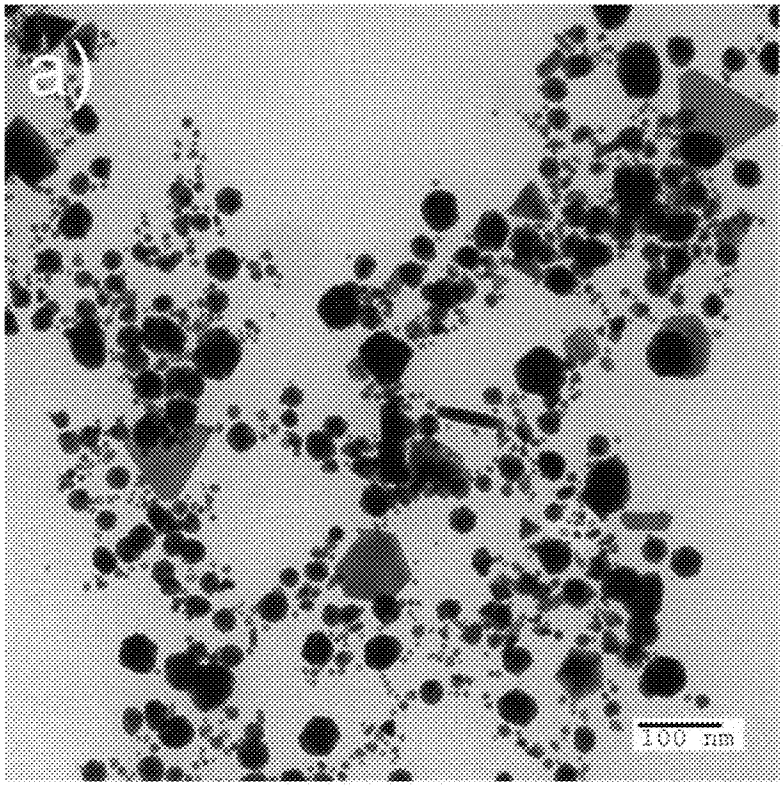

Gold and Palladium Nanoparticle Synthesis (S1-S2):

Referring to FIGS. 13A to 13C, for each of syntheses S1 and S2, the color of the electrolyte solution changed drastically within a few seconds, revealing the nucleation of gold or palladium nanoparticles. More particularly, for S1 (Au), the color of the electrolyte solution changed from clear yellow (FIG. 13A) to dark purple (FIG. 13B), while for S2 (Pd), the color changed from pale yellow to dark brown (FIG. 13C). Referring to FIGS. 14A and 14B, TEM images for S1 and S2 revealed the presence of polydisperse nanoparticles. For Au-based nanoparticles (S1), most of the diameters of the nanoparticles ranged from about 5 to 90 nm (FIG. 14A). Meanwhile, for Pd-based nanoparticles (S2), the diameters were significantly smaller, lying mostly in the range from 3 to 10 nm (FIG. 14B).

Figure 15B:
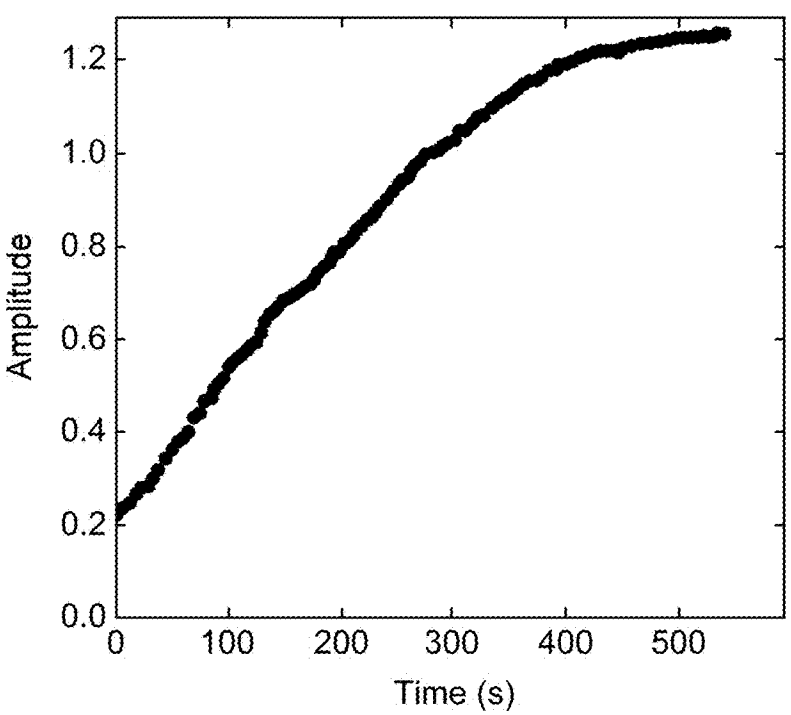
FIGS. 15B and 15C illustrate respectively the time-evolution of the amplitude and central wavelength of the Gaussian of FIG. 15A.
Figure 15A:
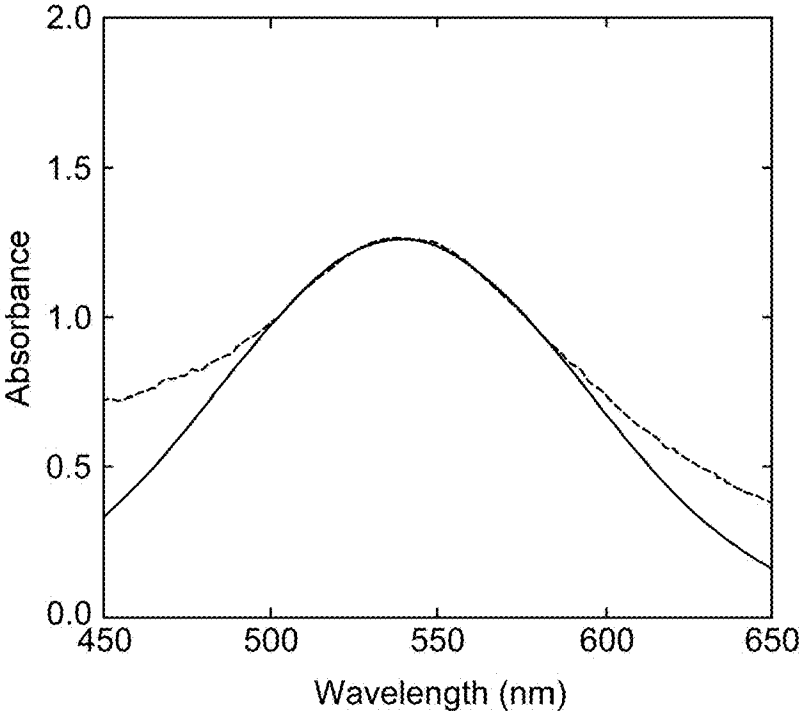
FIG. 15A illustrates an in situ ultraviolet-visible (UV-vis) absorbance spectrum (dotted line curve) of a gold nanoparticle suspension (synthesis S3) and corresponding real-time Gaussian fitting (solid line curve), each plotted as a function of wavelength in the range from 450 to 650 nm.
Figure 15D:
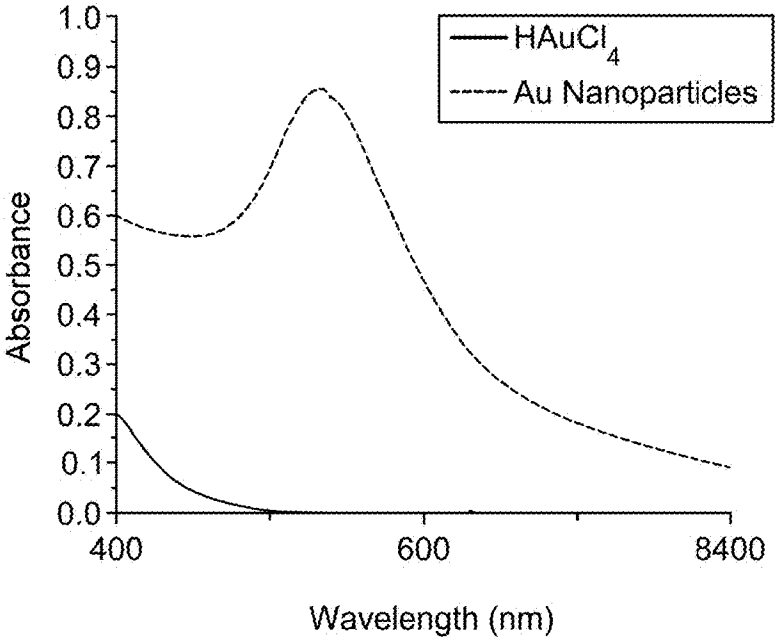
FIG. 15D illustrates an ex situ absorbance spectrum (dotted line curve) of another gold nanoparticle suspension (synthesis S1) and of the corresponding initial electrolyte solution (solid line curve), each plotted as a function of wavelength in the range from 400 to 800 nm.
Figure 15C:
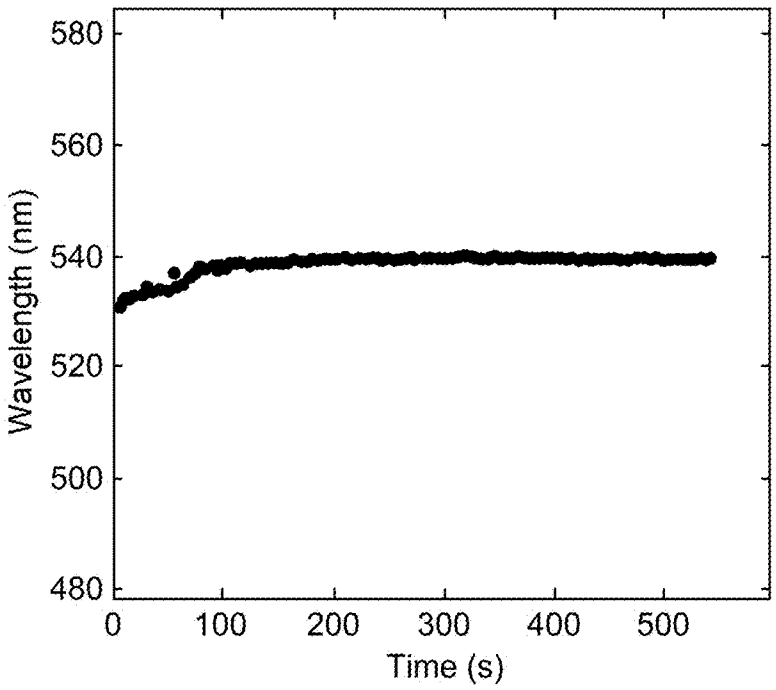
Figure 16B:
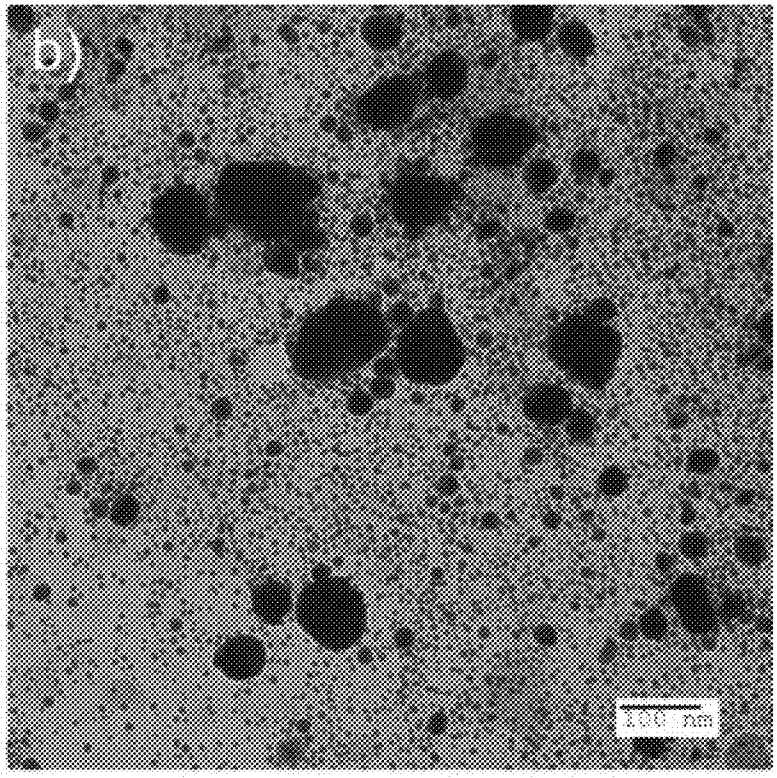
FIGS. 16A to 16D are TEM images of gold nanoparticles synthesized according to four implementations (syntheses S4, S5, S1 and S6, respectively) of the method described herein.
Figure 16A:
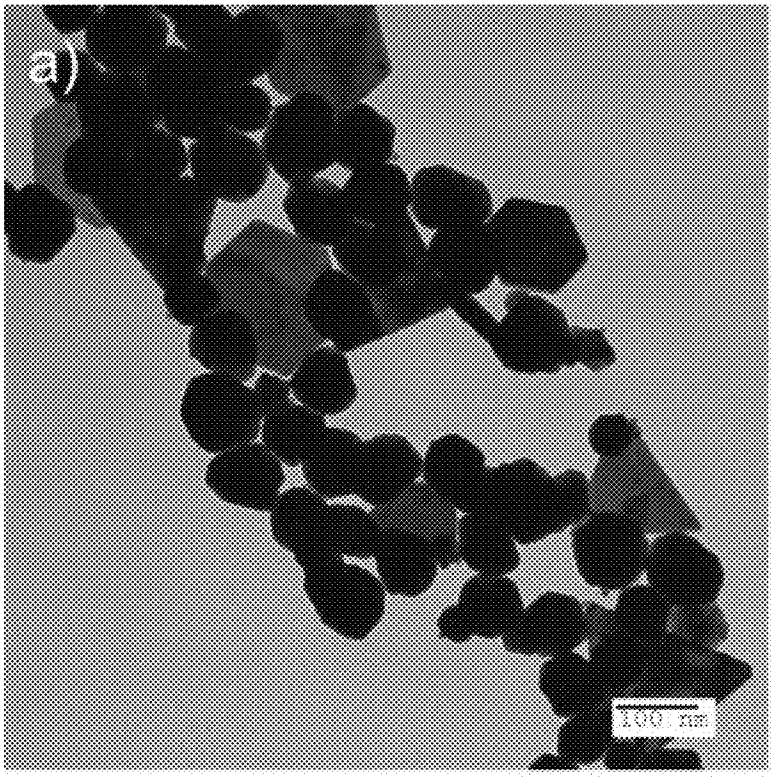
Figure 16D:
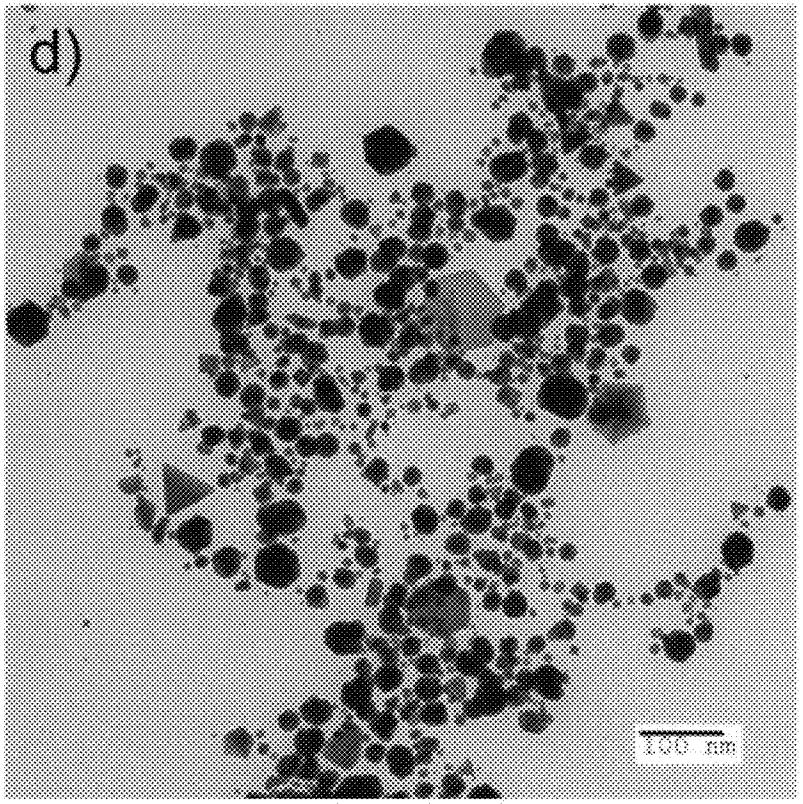
Figure 16C:
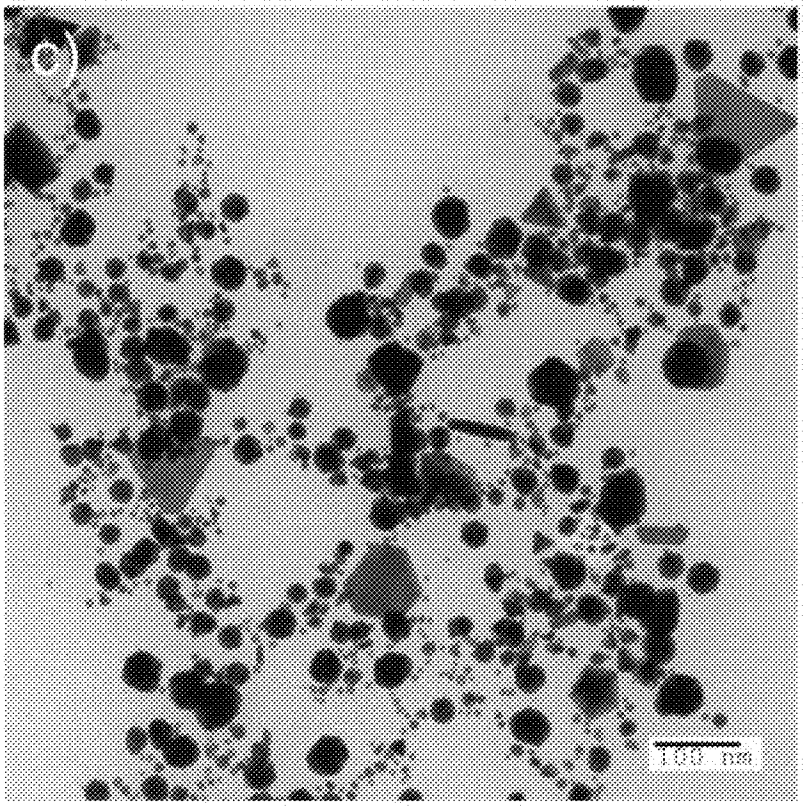

In Situ Characterization of Gold Nanoparticle Suspensions:

Referring now to FIGS. 15A to 15C, a gold nanoparticle synthesis procedure (S3) was followed in situ by UV-Vis absorbance spectroscopy. FIG. 15A is an example of a gold nanoparticle spectrum acquired in real time (dashed line). The peak around 545 nm is the characteristic plasmon resonance peak of gold nanoparticles. This peak is a strong indication of: (i) the presence of gold nanoparticles, as gold ions do not exhibit this plasmon peak; (ii) their size evolution, as small particles have plasmon peak at shorter wavelengths; and (iii) their relative concentration in the liquid, as indicated by the stronger total absorption. The solid line in FIG. 15A is a Gaussian curve that was fitted to the absorbance spectrum, in real-time, using a least-mean-square-error algorithm. FIGS. 15B and 15C respectively show the time-evolution of the amplitude and central wavelength (horizontal position) of the Gaussian curve of FIG. 15A. These measurements allow for the nanoparticle synthesis to be monitored in real time. In particular, FIG. 15C can provide an indication of the size evolution of the particles, the smallest particles having a plasmon peak closer to 530 nm.

By comparison with results obtained in real-time with S3, FIG. 15D is an ex situ visible absorbance measurement of the initial electrolyte solution and the final product of synthesis S1, each plotted as a function of wavelength in the range from 400 to 800 nm. The presence of a plasmon resonance peak in FIG. 15D is readily discernable.

Effect of the Concentration of Dextran on the Shape and Size of Gold Nanoparticles (S4-S6):

It was observed that the concentration of dextran can strongly influence the size of the synthesized gold nanoparticles. In this regard, FIGS. 16A to 16D respectively depicts TEM images of the S4, S5, S1 and S6 nanoparticles (magnification: 49000×). It can be seen that a low concentration of dextran (0.1 mM; S4) is associated with bigger (~80 nm) and less polydisperse nanoparticles. It can also be seen that increasing the dextran concentration leads to broader size distributions (in the range of 10 to 30 nm for 2.0 mM; S6). Several indications of complex-shaped particles, as well as a clear multi-distribution state, were found for syntheses S1 and S6. Referring back to FIGS. 13A and 13B, the color of the electrolyte solution for S4 to S6 also changed within a few seconds.

Figure 17B:
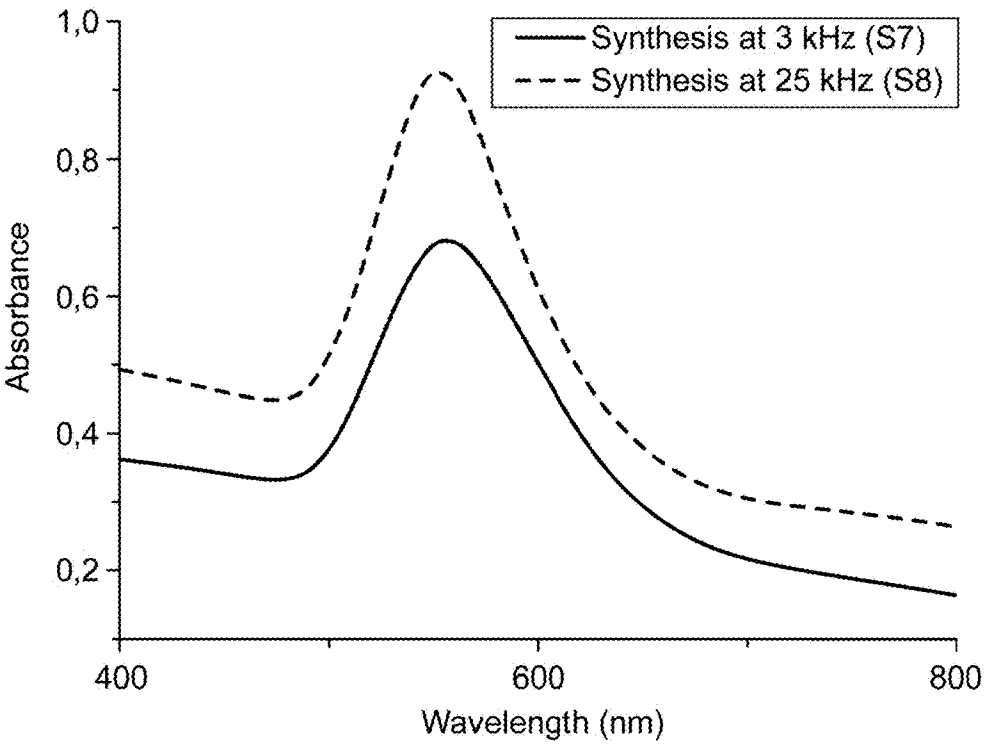
FIGS. 17A and 17B illustrate the difference in opacity (FIG. 17A) and absorption spectrum (FIG. 17B) of two nanoparticle synthesis procedures (syntheses S7 and S8) performed under identical experimental conditions except for the frequency of the applied electrical signal for generating the plasma.
Figure 17A:
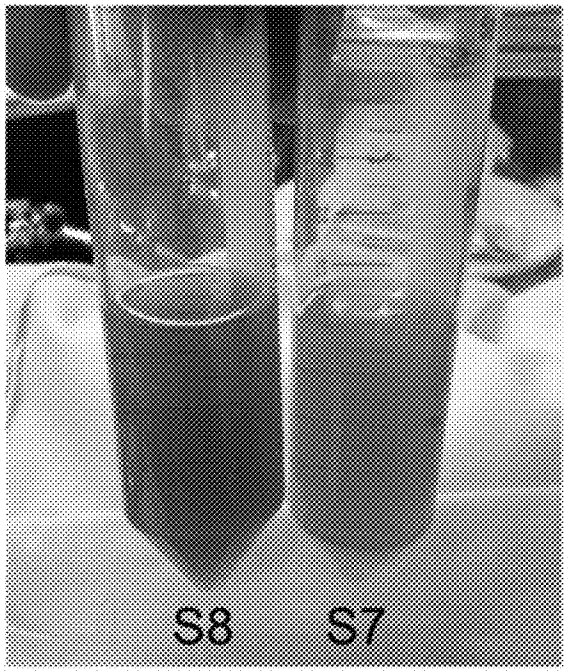

Effect of the Electrical Frequency and Current on the Efficiency of the Plasma Synthesis (S7-S8):

For the exemplary DBD plasma apparatus used to acquire the experimental measurements described herein, the argon plasma can be generated with an electrical frequency range covering at least 3 kHz to 25 kHz. As mentioned above, the capacitive current in the apparatus is higher at 25 kHz than at 3 kHz (500 mA compared to 80 mA) for the same voltage of 7 kV. In order to show the effect of this change of frequency and current on the production rate of gold nanoparticles, two short syntheses (5 min) were made under the exact same conditions, but with different frequencies (S7 and S8). A frequency of 3 kHz was used for S7, while a higher frequency (25 kHz) was used for S8. Referring to FIGS. 17A and 17B, it is seen that the two nanoparticle suspensions have significantly different absorption properties in the visible region. In particular, the higher absorbance of S8 is indicative of a larger number of gold nanoparticles being produced during the five-minute synthesis.

Effect of the Concentration of Dextran on the Efficiency of the Plasma Synthesis (S9-S11):

Syntheses S9, S10 and S11 were obtained at higher frequency (25 kHz, 5 kV) using a fixed plasma treatment duration (12 min), and a dextran concentration of 0.1, 0.5 and 1 mM respectively. These samples were used to illustrate the efficiency of the process, that is, the total amount of metal ions converted in gold nanoparticles. For this purpose, the S9, S10 and S11 nanoparticle suspensions were centrifuged and their respective supernatants were analyzed by AAS as previously detailed. While the sediment is composed of dextran-coated gold nanoparticles, the supernatant consists of a mixture of unreacted $AuCl_4^{-1}$ ions, unreacted dextran molecules, and a limited fraction of ultra-small gold nanoparticles. Upon reaction with the plasma, UV-vis spectra exhibiting plasmon peaks at wavelengths longer than 530 nm provide a strong indication that most of the synthesized gold nanoparticles are well over 5 nm in diameter. Therefore, these samples are indicative of a rather efficient synthesis of relatively large-size gold nanoparticles.

After centrifugation, the supernatant was dissolved with aqua regia, and the concentration of gold was precisely measured by AAS. This concentration was then related to the initial amount of gold salts that were used in the precursor solutions. Table 2 below indicates, for each of S9 to S11, the fraction of the initial gold ions detected in

TABLE 2

Fraction of gold detected by AAS in the supernatant after centrifugation as a function of dextran concentration, for each of S9 to S11

| Synthesis | [dextran] mM | $[AuCl_4^{-1}]$ mM | % of Au in supernatant |
|---|---|---|---|
| S9 | 0.1 | 1.0 | <0.1 |
| S10 | 0.5 | 1.0 | 40 |
| S11 | 1 | 1.0 | 10 |

The recovery of gold in the supernatant is the smallest for the S9 synthesis, which means that almost all of the gold initially present in the form of gold ions, is collected by centrifugation in the form of gold nanoparticles. However, for the S10 and S11 syntheses, a significant resulting fraction of gold was found in the supernatant. This fraction is not necessarily attributed to gold ions, but rather to the presence of ultrasmall gold nanoparticles that are not easily sedimented by centrifugation. In this regard, the S5 synthesis, which employed the same dextran concentration as S10, clearly showed a large fraction of ultrasmall gold nanoparticles (see FIG. 16B). These particles are not efficiently sedimented by centrifugation, and are more likely to remain in the supernatant. Therefore, for these implementations, the centrifugation parameters could be investigated further in order to optimize nanoparticle recovery. Finally, another aspect that could be investigated further is the ripening time of nanoparticles. Indeed, it has been observed, in some implementations, that nanoparticle growth can continues after the synthesis itself and, in particular, that nanoparticles left to rest for 24 hours tend to appear larger in UV-vis spectroscopy. This preliminary finding would have to be investigated further.

Effect of the Concentration of Dextran on the Size of the Nanoparticles Synthesized (S12-S15):

Syntheses S12 to S15 were obtained using a fixed plasma treatment duration (30 min) and 20 ml of electrolyte solution containing 1 mM of Au. Table 3 below indicates, for each of S12 to S15, the dextran concentration in each one of the electrolyte solutions of S12 to S15.

TABLE 3

Dextran concentration for each of S12 to S15

| Synthesis | [dextran] mM |
|---|---|
| S12 | 0.1 |
| S13 | 0.2 |
| S14 | 0.5 |
| S15 | 1 |

Figure 18A:
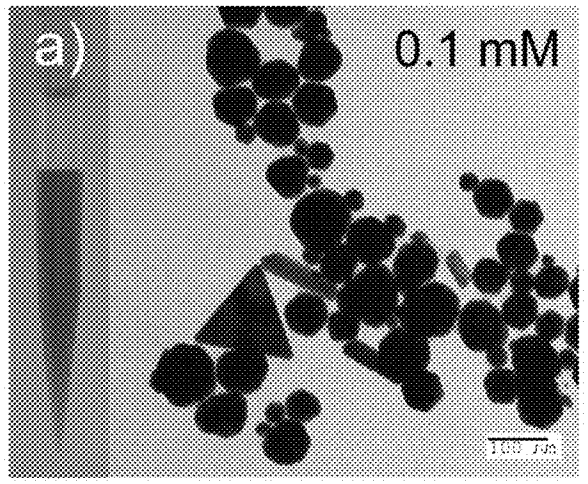
FIGS. 18A to 18D are TEM images of gold nanoparticles synthesized according to four implementations (syntheses S12 to S15, respectively) of the method described herein.
Figure 18A:
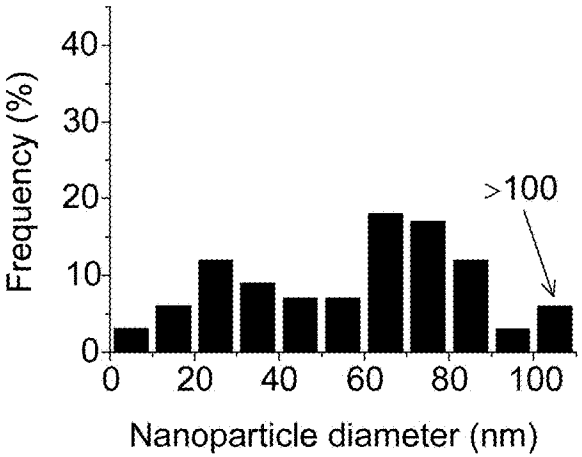
Figure 18B:
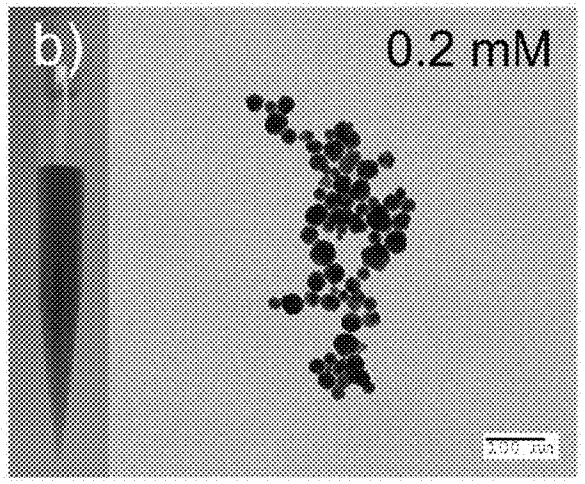
Figure 18B:
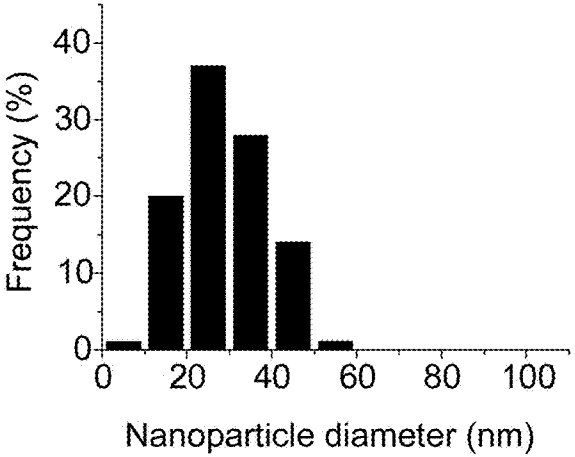
Figure 18C:
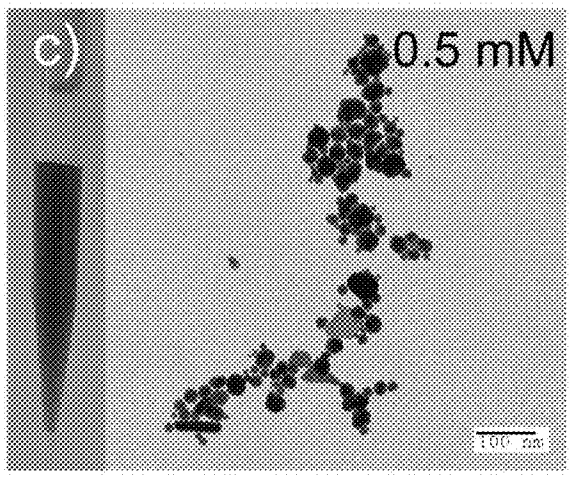
Figure 18C:
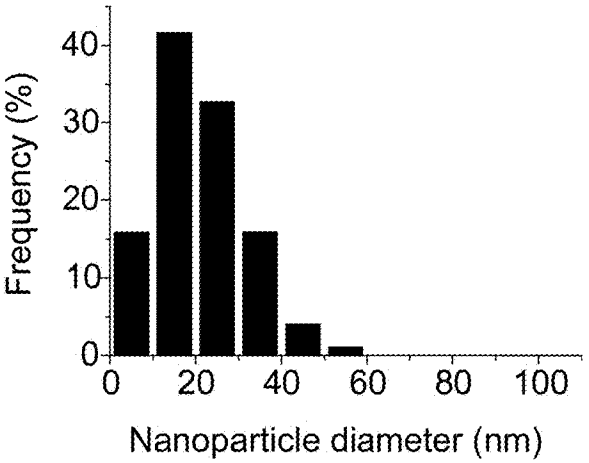
Figure 18D:
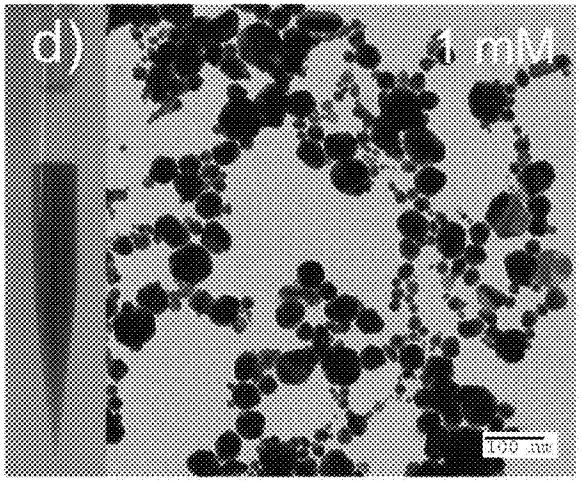
Figure 18D:
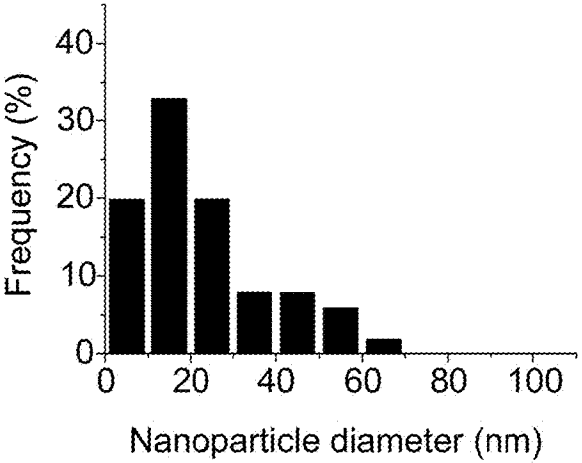

It can be seen in FIGS. 18B to 18D that in S13 to S15, the mean diameter of the produced nanoparticles is comprised between about 10 and 30 nm, whereas in FIG. 18A depicting S12, a concentration of dextran of 0.1 mM has the effect of producing nanoparticles having a larger mean diameter, being comprised between about 50 and 80 nm. Thus, a lower concentration of dextran, as surfactant, seems to lead to larger particle size.

Figure 19A:
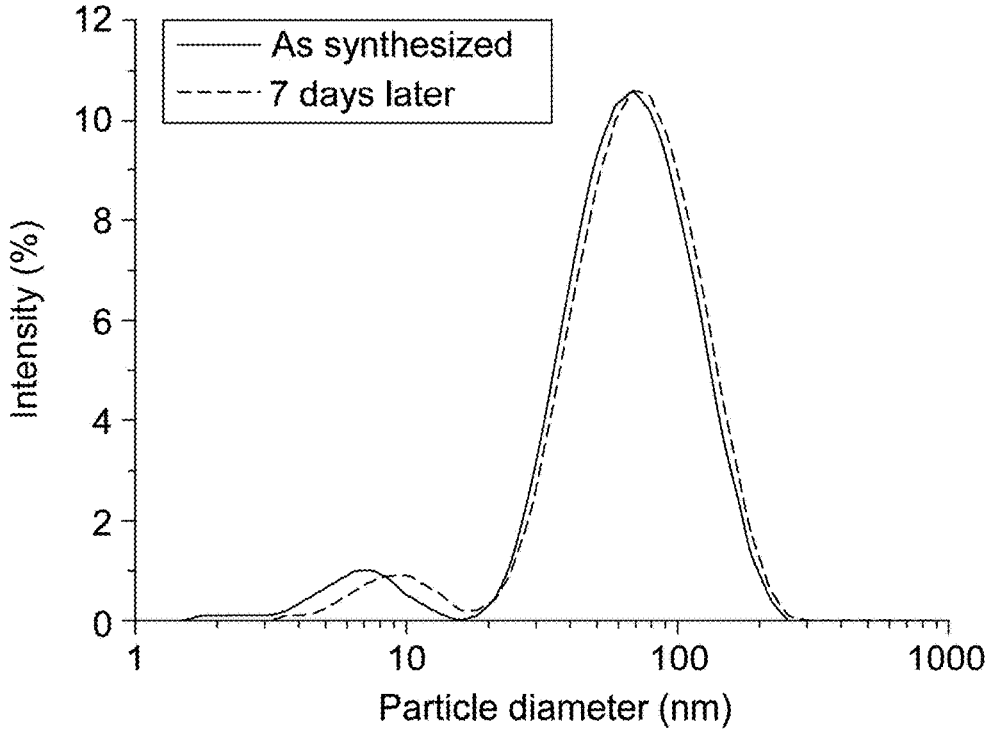
FIGS. 19A and 19B illustrate the stability in water of the nanoparticles synthesized using the method described herein.
Figure 19B:
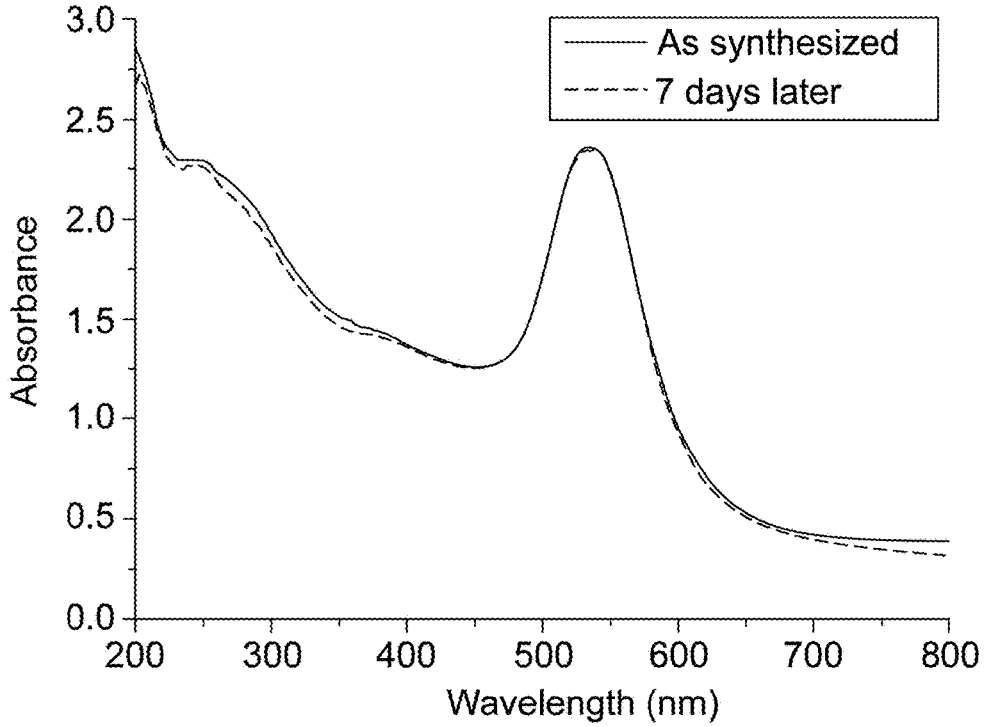

Stability in Water of the Nanoparticles Synthesized Using the Method Described Herein:

Referring to FIG. 19A, there is shown the distribution of the particle diameter in water wherein the nanoparticles were synthesized using 0.2 mM of dextran in the electrolyte solution. The diameter of the nanoparticles was measured using dynamic light scattering (DLS) techniques. It can be appreciated that the diameter of the nanoparticles remains stable 7 days after synthesis of the nanoparticles. Referring to FIG. 19B, there is shown that the spectrum of absorbance of UV-Visible light remains mostly unchanged 7 days after synthesis of the nanoparticles.

Figures 20A, 20B:
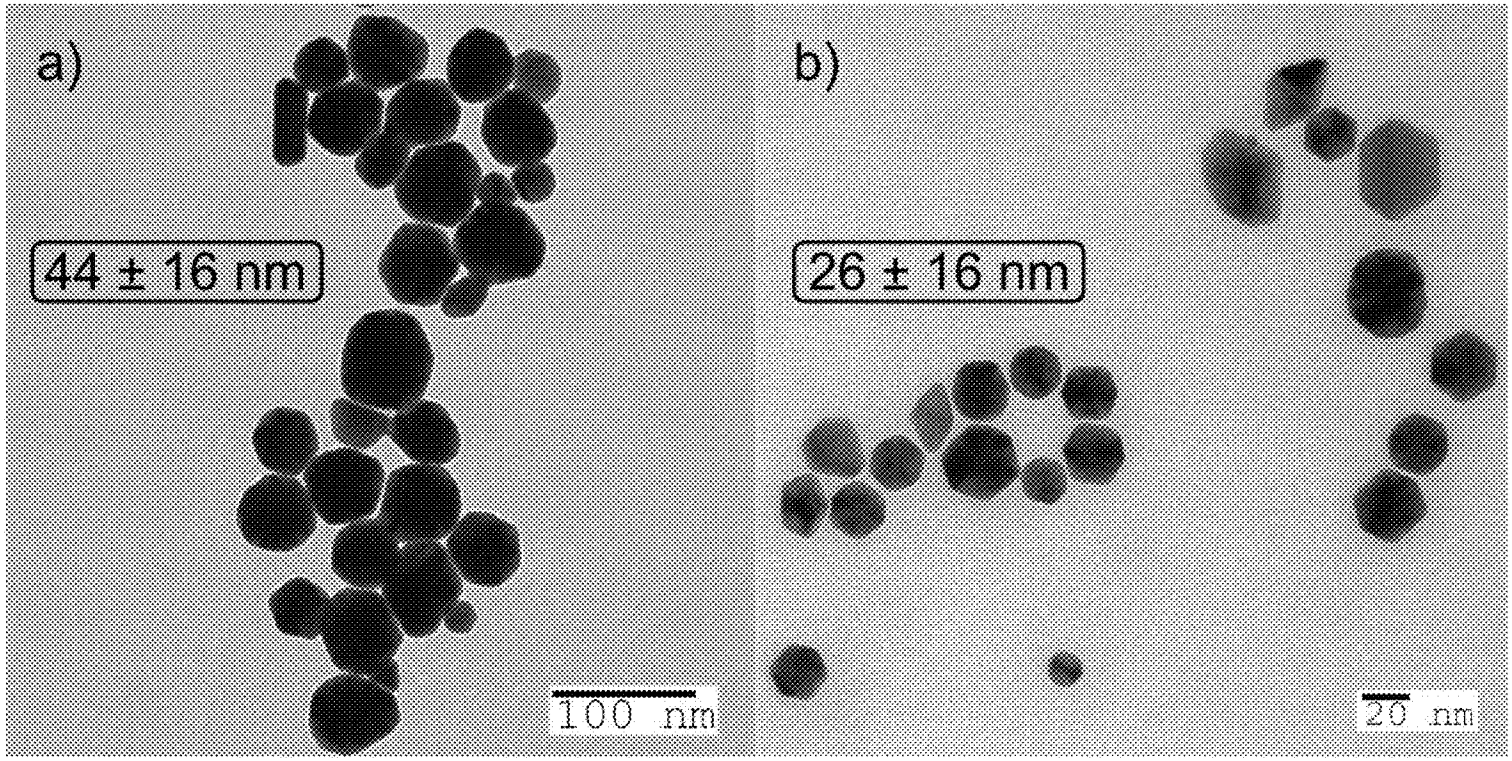
FIGS. 20A and 20B are TEM images of radioactive gold nanoparticles synthesized according to one implementation (synthesis S16) of the method described herein.
Figure 21A:
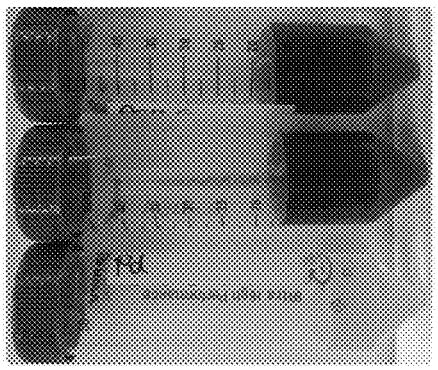
FIGS. 21A to 21D show a difference in opacity and absorption spectrum of nanoparticle synthesis of palladium (Pd), platinum (Pt), rhodium (Rh) and iridium (Ir), respectively.
Figure 21A:
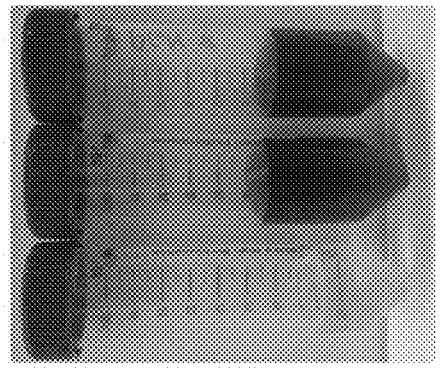
Figure 21A:
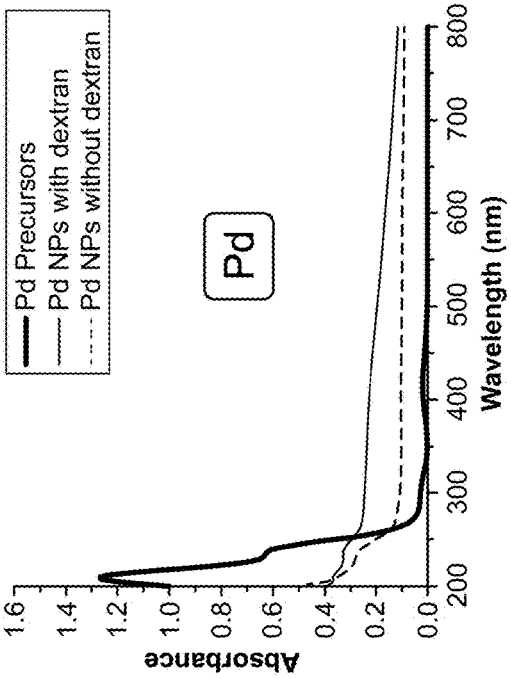
Figure 21B:
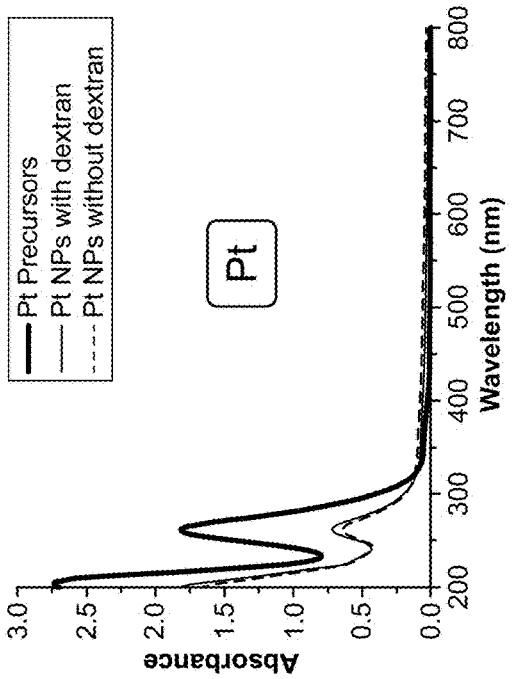
Figure 21C:
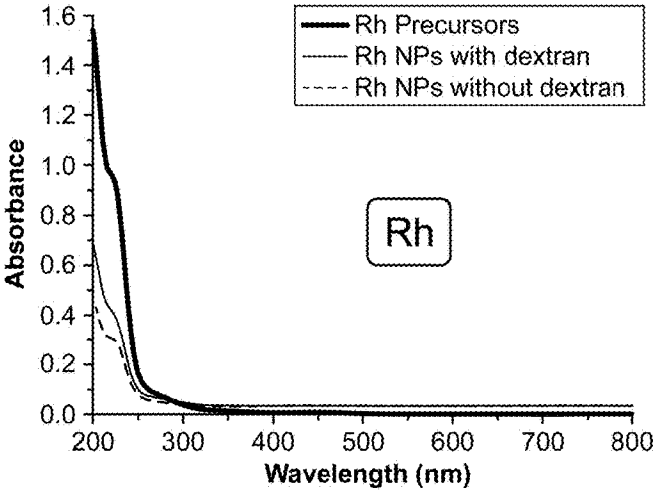
Figure 21D:
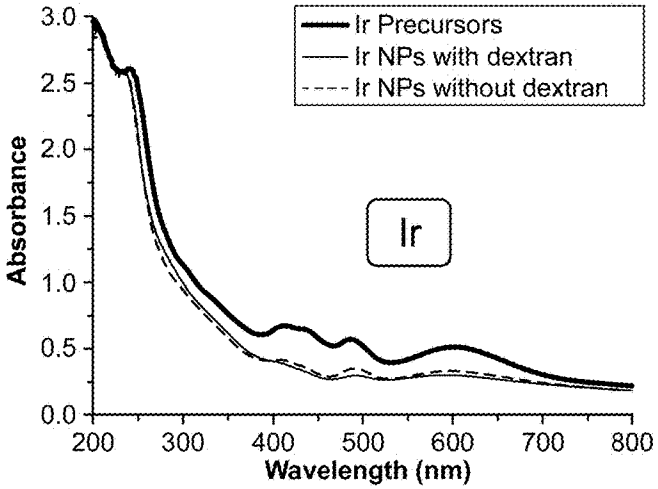

Synthesis of Radioactive Gold Nanoparticles:

Referring to FIGS. 20A and 20B, there is shown radioactive gold nanoparticles synthesized according to synthesis S16, wherein the plasma treatment duration was 30 min and 20 ml of electrolyte solution containing 1 mM of Au were used. In addition, the electrolyte solution contained 0.2 mM of dextran and 500 μCi of radioactive gold (198 Au) precursor. Both populations of nanoparticles illustrated in FIGS. 20A and 20B were obtained from the same synthesis S16, after separation by centrifugation and filtration according to the particle size. An X-Ray diffraction analysis was performed on the nanoparticles obtained from S16.

Syntheses of Pd, Pt, Rh and Ir Nanoparticles:

Referring to FIGS. 21A to 21D, each sample shown on the left of each image is a sample including an electrolyte solution with metal precursors dissolved therein prior to a particle synthesis process. Each sample shown in the middle of each image has been subjected to the particle synthesis process and wherein 1 mM of dextran was added to the electrolyte solution prior to the synthesis process. Finally, each sample shown on the right of each image has also been subjected to the particle synthesis process but without dextran addition to the electrolyte solution. In each sample, the concentration of the metal dissolved in the electrolyte solution, prior to the synthesis process, was 1 mM. Each synthesis process was conducted using the above-described DBD plasma apparatus and, more particularly, the embodiment described above in reference to FIG. 6A. During the particle synthesis process, an electrical potential difference of 7.5 kV for 10 minutes of plasma treatment was applied and hydrogen was supplied as reacting gas.

Referring to the graphs of FIGS. 21A to 21D, there is shown that the nanoparticle suspensions obtained from the respective synthesis of Pd, Pt, Rh and Ir have different absorption properties in the UV-visible region depending notably on whether or not dextran is present in the electrolyte solution.

Of course, numerous modifications could be made to the embodiments described above without departing from the scope of the present invention.

The invention claimed is:

1. A method for synthesizing metal particles, comprising:

providing a dielectric barrier discharge (DBD) plasma apparatus, the DBD plasma apparatus comprising an electrolyte vessel, an electrode spaced-apart from the electrolyte vessel, and a dielectric barrier interposed, in a planar configuration, between the electrolyte vessel and the electrode;

introducing an electrolyte solution comprising metal ions inside the electrolyte vessel, the electrolyte solution having an upper surface spaced-apart from the dielectric barrier;

supplying gas into a discharge area extending along and between the upper surface of the electrolyte solution and the dielectric barrier; and applying, across the dielectric barrier, an alternating or pulsed direct electrical potential difference between the electrode and the electrolyte solution, the electrolyte solution acting as a counter-electrode polarized against the electrode, an amplitude of the electrical potential difference being sufficient to produce a plasma in the discharge area and onto the electrolyte solution so as to interact with the metal ions and thereby synthesize the metal particles.

2. The method according to claim 1, wherein the supplying of the gas comprises continuously supplying the gas into the discharge area and evacuating gas therefrom.

3. The method according to claim 1, wherein the introducing of the electrolyte solution further comprises conveying a flow of the electrolyte solution at least one time along an electrolyte flow path from an electrolyte inlet port to an electrolyte outlet port of the electrolyte vessel.

4. The method according to claim 3, wherein the conveying of the flow of the electrolyte solution comprises conveying the flow of the electrolyte solution multiple times along the electrolyte flow path.

5. The method according to claim 1, further comprising cooling the electrode.

6. The method according to claim 1, wherein the electrode is a liquid electrode contained in an electrode cell, the method further comprising: continuously conveying a liquid of the liquid electrode in the electrode cell, and evacuating heat from the DBD plasma apparatus through the continuously conveyed liquid of the liquid electrode.

7. The method according to claim 6, wherein at least a surface of the electrode cell is the dielectric barrier.

8. The method according to claim 1, further comprising at least one of: monitoring and controlling a vertical gap between the upper surface of the electrolyte solution contained inside the electrolyte vessel and the dielectric barrier; monitoring a temperature of the electrolyte solution inside the electrolyte vessel and controlling the temperature of the electrolyte solution between about 0° C. and about 95° C.; and monitoring in real-time a spectral response of the synthesized metal particles.

9. The method according to claim 1, further comprising grounding the electrolyte solution.

10. The method according to claim 1, wherein the synthesized metal particles comprise Au, Pd, Pt, Ir, Os, Re, Ru, Rh, Ag, Ni, Cu, Fe, Mn, Co, or mixtures thereof.

11. The method according to claim 1, wherein the metal ions comprise noble metal ions, transition metal ions, or mixtures thereof.

12. A dielectric barrier discharge (DBD) plasma apparatus for synthesizing metal particles, the DBD plasma apparatus comprising:

an electrolyte vessel for receiving an electrolyte solution comprising metal ions;

an electrode spaced-apart from the electrolyte vessel;

a dielectric barrier interposed, in a planar configuration, between the electrolyte vessel and the electrode such that, when the electrolyte solution is present in the electrolyte vessel in a synthesis region thereof, the dielectric barrier and an upper surface of the electrolyte solution in the synthesis region are spaced-apart from each other and define a discharge area extending therealong and therebetween; and at least one gas inlet port and at least one outlet port in fluid communication with the discharge area such that, when the electrolyte solution is present in the electrolyte vessel, supplying gas in the discharge area while applying, using an electrical power source, an alternating or pulsed direct electrical potential difference across the dielectric barrier and between the electrode and the electrolyte solution, the electrolyte solution acting as a counter-electrode polarized against the electrode, cause a plasma to be produced in the discharge area and onto the electrolyte solution so as to interact with the metal ions and thereby synthesize the metal particles.

13. The DBD plasma apparatus according to claim 12, wherein the upper surface of the electrolyte solution and the dielectric barrier extend parallel to and are separated from each other by a vertical gap when the electrolyte solution is contained in the electrolyte vessel, the vertical gap having a height of about 1 mm to about 10 mm.

14. The DBD plasma apparatus according to claim 12, wherein the electrode is a liquid-based electrode comprising an electrically conductive liquid contained in at least one liquid containable cell.

15. The DBD plasma apparatus according to claim 14, wherein the dielectric barrier is a bottom surface of the at least one liquid-containable cell.

16. The DBD plasma apparatus according to claim 15, wherein the liquid-based electrode further comprises at least one electrically-conducting element connectable to the electrical power source to create the alternating or pulsed direct electrical potential difference, each one of the at least one electrically-conducting element being inserted in a respective one of the at least one liquid-containable cell.

17. The DBD plasma apparatus according to claim 12, further comprising a ground for grounding the electrolyte solution contained in the electrolyte vessel.

18. The DBD plasma apparatus according to claim 12, comprising a housing including a base and a removable mating cover, the base defining an electrolyte vessel receiving cavity and the electrolyte vessel being removably insertable in the electrolyte vessel receiving cavity of the housing, and wherein the at least one gas inlet port and the at least one gas outlet port extend through the housing and are in gas communication with the discharge area.

19. The DBD plasma apparatus according to claim 12, further comprising at least one of:

a temperature control device including at least one temperature probe configured to monitor an electrolyte temperature, at least one of the temperature probe including a metal cladding in contact with the electrolyte solution contained in the electrolyte vessel and electrically grounding same to earth; and a spectroscopy cell in fluid communication with the electrolyte vessel, mounted downstream of the electrolyte output port.

20. The DBD plasma apparatus according to claim 12, wherein the electrolyte vessel is free of metallic electrode in contact with the electrolyte solution contained in the synthesis region.

21. The DBD plasma apparatus according to claim 12, wherein the electrolyte vessel comprises an electrolyte inlet port, an electrolyte outlet port, the electrolyte solution being configured to flow along an electrolyte flow path between the electrolyte inlet and the electrolyte outlet.

22. The DBD plasma apparatus according to claim 21, further comprising a pump inducing an electrolyte flow along the electrolyte flow path, an inlet tubing line in fluid communication with the electrolyte inlet port, an outlet tubing line in fluid communication with the electrolyte outlet port, at least one of the inlet tubing line and the outlet tubing line being operatively connected to the pump to induce the electrolyte flow.

23. The DBD plasma apparatus according to claim 22, wherein the inlet tubing line, the outlet tubing line, the electrolyte flow path, and the pump defines an electrolyte closed-loop flow circuit.

* * * * *